US008100436B2

(12) United States Patent
Heine et al.

(10) Patent No.: US 8,100,436 B2
(45) Date of Patent: Jan. 24, 2012

(54) DATA SUPPORT WITH AN OPTICALLY VARIABLE STRUCTURE

(75) Inventors: Astrid Heine, Kirchheim (DE); Roger Adamczyk, Isen (DE); Christof Baldus, München (DE); Karlheinz Mayer, Blaichach (DE); Peter Franz, Pienzenau/Bruck (DE)

(73) Assignee: Giesecke & Devrient GmbH, Munich (DE)

( * ) Notice: Subject to any disclaimer, the term of this patent is extended or adjusted under 35 U.S.C. 154(b) by 757 days.

(21) Appl. No.: 11/660,144

(22) PCT Filed: Aug. 11, 2005

(86) PCT No.: PCT/EP2005/008758

§ 371 (c)(1),
(2), (4) Date: Feb. 13, 2007

(87) PCT Pub. No.: WO2006/018232

PCT Pub. Date: Feb. 23, 2006

(65) Prior Publication Data

US 2007/0246932 A1 Oct. 25, 2007

(30) Foreign Application Priority Data

Aug. 13, 2004 (DE) ..... 10 2004 039 595
Mar. 14, 2005 (DE) ..... 10 2005 011 612

(51) Int. Cl.
*B42D 15/00* (2006.01)
*B42D 15/10* (2006.01)

(52) U.S. Cl. ..... 283/72; 283/93; 283/114

(58) Field of Classification Search ..... 283/72, 283/85, 87, 91, 93–94, 114
See application file for complete search history.

(56) References Cited

U.S. PATENT DOCUMENTS

| | | | | |
|---|---|---|---|---|
| 4,033,059 | A | 7/1977 | Hutton et al. | |
| 4,124,947 | A * | 11/1978 | Kuhl et al. | 283/91 |
| 5,797,632 | A * | 8/1998 | Rice | 283/114 |
| 6,036,233 | A * | 3/2000 | Braun et al. | 283/91 |
| 6,176,521 | B1 | 1/2001 | Mancuso | |
| 6,176,522 | B1 | 1/2001 | Jackson | |
| 2004/0011107 | A1 | 1/2004 | Boegli | |

FOREIGN PATENT DOCUMENTS

| | | |
|---|---|---|
| CA | 1019012 | 10/1977 |
| CA | 2 421 101 A1 | 3/2003 |
| CA | 2496829 A1 | 3/2004 |

(Continued)

OTHER PUBLICATIONS

Van Renesse, Rudolf L., "Optical Document Security," Artech House 1999, Chapter 15, pp. 298-301, 315-316.

(Continued)

*Primary Examiner* — Dana Ross
*Assistant Examiner* — Kyle Grabowski
(74) *Attorney, Agent, or Firm* — Bacon & Thomas, PLLC

(57) ABSTRACT

The invention relates to a security element with an optically variable structure, which has an embossed structure and a coating, wherein the embossed structure and the coating are combined such that at least parts of the coating are completely visible upon perpendicular viewing, but are concealed upon oblique viewing. This embossed structure has nonlinear embossed elements, which are combined with the coating such that when changing the viewing direction different pieces of information become visible.

30 Claims, 20 Drawing Sheets

FOREIGN PATENT DOCUMENTS

| | | | |
|---|---|---|---|
| CN | 1452566 | A | 10/2003 |
| CN | 01469801 | A | 1/2004 |
| DE | 102 43 863 | | 2/2004 |
| GB | 1 390 302 | | 4/1975 |
| RU | 2172679 | C1 | 8/2007 |
| WO | 97/17211 | | 5/1997 |
| WO | 98/47715 | | 10/1998 |
| WO | 99/48697 | | 9/1999 |
| WO | 02/20280 | A1 | 3/2002 |
| WO | WO 02/24470 | | 3/2002 |
| WO | 2004/022355 | A2 | 3/2004 |
| WO | 2004/030928 | A1 | 4/2004 |

OTHER PUBLICATIONS

"Handbuch der Printmedien," Springer Verlag, 2000, p. 44.

* cited by examiner

DATA SUPPORT WITH AN OPTICALLY VARIABLE STRUCTURE

FIELD OF THE INVENTION

The invention relates to a data carrier with an optically variable structure, which has an embossed structure and a coating contrasting to the surface of the data carrier, wherein the embossed structure and the coating are combined such that at least parts of the coating are completely visible upon perpendicular viewing, but are concealed upon oblique viewing and when viewed from at least one predetermined viewing angle a first information is recognizable, which upon perpendicular viewing is not visible or only faintly visible.

BACKGROUND

For protection against imitation, in particular with color copying machines or other reproducing methods, data carriers, such as for example bank notes, papers of value, credit or ID cards, passports, deeds and the like, labels, packaging or other elements for the product protection, are equipped with optically variable security elements. The protection from forgery here is based on the fact that the visually simply and distinctly recognizable optically variable effect cannot be reproduced or only insufficiently reproduced by the above-mentioned reproducing devices.

For example, from CA 10 19 012 a bank note is known, which in a partial area of its surface is provided with a parallel printed line pattern. For producing the optically variable effect additionally a line structure is embossed into the data carrier in the area of this printed line pattern, so that flanks are formed, which each are visible only when viewed from certain viewing angles. By selectively arranging the line pattern on flanks of the same orientation, upon oblique viewing of the flanks provided with the lines these lines are visible, upon oblique viewing of the back of the flanks the line pattern is not recognizable. When in partial areas of the embossed area of the line screen or the embossed screen phase shifts are provided, then information is representable, which is only recognizable either when viewed from the first oblique viewing angle or when viewed from the second viewing angle.

With such an optically variable security element the tilt effect is very sharply defined, but occurs only in a very narrow viewing angle range. For the visual check of the known optically variable elements, therefore, exactly this viewing angle range must be found, so that these optically variable elements are less suitable for a simple visual check.

Therefore, it is the problem of the present invention to improve an optically variable security element with respect to its forgery-proofness and with respect to its visual checkability.

SUMMARY OF THE INVENTION

According to the invention the optically variable structure consists of a coating and an embossed structure overlapping this coating. The embossed structure has nonlinear embossed elements, which are combined with the coating such that when changing the viewing direction different pieces of information become visible. The nonlinear embossed elements are characterized in particular by at least three flanks, these flanks having dimensions permitting the shadowing effect according to the invention. I.e., the flanks must be dimensioned such that for a viewer, who views such a flank, an information lying behind this flank at least partially is concealed. The flanks of the nonlinear embossed elements thus form plane or curved areas, which either constantly merge into one another, as it is the case for example with surface areas of rotationally symmetrical, three-dimensional forms (e.g. segments of a sphere, frustums of a cone) or abut under a certain angle, as it is the case for example with polygonal three-dimensional forms (e.g. pyramids, tetrahedrons). The nonlinear embossed elements can have flanks of plane and/or curved areas, in particular the embossed elements can have e.g. the form of n-sided pyramids, tetrahedrons, frustums of a pyramid, segments of a cylinder, cones, conic sections, paraboloids, polyhedrons, cuboids, prisms, sectors of a sphere, segments of a sphere, spherical segments, hemispheres, barrel-shaped bodies or tori. But the nonlinear embossed elements can also be formed as a so-called divided torus, wherein the torus is divided in parallel to that plane, in which lies the large radius of the torus. Especially preferred is the use of embossed elements in the form of segments of a sphere, or three- or four-sided pyramids. The nonlinear embossed elements preferably are tactile.

Moreover, the nonlinear embossed elements according to the invention have the advantage, that in a simple fashion more than two pieces of information can be placed in the optically variable element, which become visible under different viewing angles, since the nonlinear embossed elements have a plurality of flanks, on which the information or parts of the information can be disposed selectively and separate from each other.

Depending on form, height and dimension of the nonlinear embossed elements, special visual effects can be selectively produced. For example, nonlinear embossed elements in the form of pyramids or frustums of a cone with steeper flanks produce a more contrasting effect when tilted than e.g. nonlinear embossed elements in the form of flattened spherical segments with an equal embossing height.

An embossed structure with embossed elements tapered on the top normally renders the same information in a different appearance than an embossed structure with knobs flattened on the top, which e.g. form plateaux. However, pyramidal embossed elements or embossed elements in the form of spherical segments or hemispheres are preferred for the invention.

The nonlinear embossed elements may be disposed to each other in any fashion so as to thereby produce a certain embossed structure. At least a part of the embossed structure can consist of screenlike disposed nonlinear embossed elements. Here the nonlinear embossed elements constitute the screen dots.

The term "screen dots" shall be understood in the meaning as usual in printing technology. The screen dots have a superficial extent in the substrate level and are not point-shaped in a mathematical sense. The employed analogy exists between the dot size (or superficial extent) of the screen dots and the base of the nonlinear embossed elements in the data carrier level. Here the base of the nonlinear embossed elements in the data carrier level actually is a projection of the embossed element geometry into the data carrier level.

The following explanation follows the "Handbook of printing media" ("Handbuch der Printmedien"), Publishing House Springer, page 44 ff. Accordingly, screen dots can be disposed in a constant periodical screen, which means an arrangement with equal distances between the dots, equal dot sizes and an unvarying dot form over the entire screen. Due to the possibility to vary the dot size a so-called amplitude-modulated periodical screen is the result. A nonperiodical frequency-modulated screen of 1st order is present, when the distance between the dots is selected to be variable and dot size and dot form are selected to be unvarying. Both possibilities will result in advantageous embossed structures when applied for the arrangement of the nonlinear embossed elements.

A structure having screen dots with a variable distance between the dots, a variable dot size and an unvarying dot form is referred to as nonperiodical screen of 2nd order. It has been shown, that analogous to this an embossed structure can be produced which is also suitable for the invention.

Likewise, a screen is thinkable, wherein all three parameters may be varied and which is referred to as nonperiodical screen of 3rd order. An embodiment and arrangement of the nonlinear embossed structures analogous to this is also thinkable.

All these types of screens may be employed within the terms of the invention.

The coating of the optically variable structure can be a metal layer, a metallic effect layer or an optically variable layer, which is present in an all-over or a structured fashion on the object to be protected. Alternatively, the coating can be any, preferably printed, geometric pattern. The coating may be formed of differently colored basic pattern elements, such as lines, triangles etc. These basic pattern elements may be disposed as a result of chance, but may be selected with regard to their dimensions such that the viewer perceives the coating as a homogeneous colored surface.

The basic pattern elements may also have at least one colored surface, geometric patterns, alphanumeric characters or any image motifs. The different colored surfaces and/or pieces of information of the basic pattern element here preferably are disposed on different flanks of the nonlinear embossed element, so that the individual colored surfaces and/or pieces of information become visible from different viewing angles.

Alternatively, the basic pattern elements may also represent a part of any printed image, such as a guilloche pattern or an image motif. For example, in the case of a multicolored guilloche pattern the basic pattern elements may constitute crossing points of the guilloche lines. The basic pattern element here consists of differently colored line segments crossing each other, the length of which is determined by the nonlinear embossed element disposed in this area.

In the simplest case, however, the basic pattern elements form the screen dots of a preferably printed screen.

Therefore, according to a first embodiment of the optically variable structure, embossed structures and coating have the form of a screen. The screen elements of the coating are formed by basic pattern elements, each of which has three individual elements in the colors red, green and blue. The individual elements have the form of triangles or circle segments.

The screen elements of the embossed structure have the form of three-sided pyramids, which constitute the nonlinear embossed elements. To each pyramid is allocated a basic pattern element, the differently colored individual elements of the basic pattern element are disposed on different flanks of the pyramid and the individual color components of the basic pattern elements are disposed on the flanks of the same orientation. The individual elements of the basic pattern element have the same size and all basic pattern elements of the coating have the same structure, so that upon perpendicular viewing of the optically variable structure the coating appears nearly white.

When rotating and/or tilting this optically variable structure, the portions of the basic pattern elements, which are disposed on the flanks of the pyramids that are facing away from the viewer, will be concealed. Since these portions no longer contribute to the color effect of the coating, the viewer perceives a color different than white. In the ideal case the viewer exclusively views the flanks of one color, so that the perceivable color effect changes from red to blue or green. Since the transitions depending on the viewing angle are rather indistinctly, the viewer perceives a rainbow effect. This interplay of colors is well visible for the viewer without using any aids and therefore forms a simply checkable authenticity feature. At the same time such a security element is imitable only with great effort due to the embossed structures used and the necessary guiding in register of coating and embossed structure. It therefore offers a high degree of protection from forgery.

Special optical effects can be achieved according to the invention by a variation of the form of the nonlinear embossed elements, the embodiment of the coating, variations of the arrangement of the nonlinear embossed elements and/or the coating as well as the color selection for the coating.

In the embodiment described above additional information can be produced for example by varying the coating, e.g. by omitting individual screen elements, or a variation of the form of the screen elements. Alternatively, the coating screen remains the same and the screen of the embossed structure is varied. In certain areas the nonlinear embossed elements can be disposed offset to the surroundings. A further possibility is to continuously vary the distances between the nonlinear embossed elements, i.e. the screen ruling of the embossed structure, so that with respect to the coating screen a beat occurs. Likewise, individual nonlinear embossed elements may be omitted or the form of the nonlinear embossed elements may be varied.

The combination of a basic pattern element with a nonlinear embossed element in the following is referred to as "structural element". In the example described above the combination of pyramid and three-color basic pattern element forms the structural element.

According to a further embodiment the basic pattern element of the structural element may have for example only one colored area, which is disposed on one of the flanks of the nonlinear embossed element. The remaining flanks of the nonlinear embossed element show the color of the embossed background, e.g. the white color of a paper of value. In this case when tilting and/or rotating the security element the viewer perceives an interplay between the different brightness steps of the employed color. When viewed from certain viewing angles the viewer possibly perceives only the color effect caused by the unprinted paper.

Such structural elements may also be designed in any elaborate and complicated fashion, as a result of which the protection from forgery is increased. The structural elements may be designed and disposed such, that in incident light no information is recognizable and the information is not visible until viewed under certain viewing angles. Here the coating can be single-colored, so that all recognizable pieces of information have the same color. Upon perpendicular viewing a mixed color may be recognizable. Upon oblique viewing various pieces of information in different colors become recognizable.

According to a further preferred embodiment the structural elements may be designed such that upon perpendicular viewing of the optically variable structure a multicolored image motif is recognizable, the visual effect of which, however, varies with a change of the viewing angle. This variation here ranges from a pure color change to a change of the image information represented.

In a special embodiment the structural elements correspond to the image points of a multicolored image motif, to which are allocated certain color components of a primary color system. The color components allocated to the respective image point form the basic pattern element, which is combined with an appropriate nonlinear embossed element. The total area allocated to the basic pattern element here preferably is divided into areas, which are occupied by the respective colors of the primary color system. The color effect of the basic pattern element here results from the size of the areas occupied by the respective colors. These areas may directly adjoin each other or may be disposed in overlap. The colored areas do not have to fill out the total area of the basic pattern element. In this case the color effect of the basic pattern element is also influenced by the color of the background.

If, for example, the primary color system consisting of cyan, magenta and yellow is used, in the total area intended for the basic pattern element three colored areas are provided, which are disposed such, that each of the colored areas comes to lie on a respective flank of the employed nonlinear embossed element. Upon oblique viewing or when rotating such an optically variable structure individual color components of the image information are concealed by the nonlinear embossed elements, so that the image information appears in a mixed color consisting of the colored areas of the basic pattern elements lying in viewing direction.

If the nonlinear embossed element for example has the form of a segment of a sphere, the three colored areas of cyan, magenta and yellow, which preferably have different sizes, are located on the round surface area of the embossed element. The structural element in this case consists of an embossed element in the form of a segment of a sphere, on the surface area of which are disposed differently sized colored areas of cyan, magenta and yellow, that when rotating the structural element around its axis of symmetry the different colors successively become visible. As to be able to produce an optically variable structure out of such structural elements, which upon perpendicular viewing show a colored image information, the sizes of the colored areas have to vary from structural element to structural element.

For the colored areas not necessarily primary colors have to be used, instead any color systems depending on the desired effect may be used.

It shall be explicitly pointed out, that even with less ordered embodiments, in which the repeating of the basic pattern elements and the frequency of recurrence of the embossed structure are not equal or there is no repeating at all, there can be produced interesting optically variable structures within the terms of the invention. The coating can have, for example, differently colored geometric structures as a basic pattern element, which, however, are disposed in a disordered fashion as a result of chance.

In an advantageous development of the invention the nonlinear embossed elements in their dimensioning are designed such that they produce a tactile structure well perceivable for men. The tactilely perceivable optically variable structure offers an additional protection against imitation by color photocopying or scanning the data carrier.

The optically variable structure can have an additional information, which results from a variation of the coating and/or the embossed structure. For example, the additional information can result from a variation of form, size or height of the nonlinear embossed elements. Likewise, a variation of the arrangement of the nonlinear embossed elements, such as an offset in certain areas or a change of the screen ruling in certain areas or omitting individual or a plurality of nonlinear embossed elements, is thinkable. If the coating in the area of an information is varied, this can be effected for example by a variation of form or color of the coating. Here, too, it is obvious that a variation of the arrangement of the coating is possible, such as for example an offset, a change of the screen ruling, reflection or omitting individual or a plurality of basic pattern elements.

The embossed structure additionally can be divided into partial areas, in which are disposed different partial embossed structures. Preferably, the partial embossed structures in at least two partial areas adjoining each other are disposed in an offset manner by a fraction of the screen ruling, in particular offset by one third of the screen ruling. For a better perceptibility parts of the partial embossed structures can have an unembossed edge contour.

In connection with this matrix-like arrangement of the partial embossed structures as well as the production of additional information in the area of the embossed structures or the coating explicit reference is made to WO 97/17211 and WO 02/20280 A1.

The optically variable structure according to the invention forms a security element difficult to imitate and can be directly disposed on any data carrier. The optically variable structure can also be part of a security element, which beside the optically variable structure has further security features.

The security element, for example in the area of the optically variable structure, can have a further ink layer, which preferably is translucent and disposed congruent to the raised areas of the embossed structure. Here, too, most different embodiments are possible. Some are already described, for example, in WO 2004/022355 A2, to which in this connection explicit reference is made likewise.

According to a further embodiment the security element may have further layers or authenticity features, such as e.g. a metallic layer, an additional translucent optically variable layer or a foil element. The optically variable structure may be overlaid or underlaid with such layers or elements.

Furthermore, it is also possible that the coating or printing inks used for the production of the basic pattern elements and/or the ink layer congruently disposed to the raised areas of the embossed structure at least partially are provided with machine readable properties. For this purpose magnetic, electrically conductive, luminescent additives are suitable.

The optically variable structure according to the invention or the security element according to the invention preferably is applied onto data carriers, such as for example security documents and documents of value, such as bank notes, share certificates, bond certificates, deeds, vouchers, credit cards or ID cards, passports or the like. In this way the data carriers are provided with a security element which even for laymen is easy recognizable as to increase the forgery-proofness. But the optically variable structure or the security element according to the invention also very advantageously may be used in the area of product protection. Here the optically variable structure or the security element can be applied to respective labels or packaging or directly onto the goods.

If paper is used as a data carrier material, in particular cotton vellum papers, paper-like materials consisting of plastic foils, paper coated or laminated with plastic foils or multilayer composite materials are suitable.

For producing the security element according to the invention or the optically variable structure preferably any desired substrate at first is provided with the coating and subsequently in register to this coating the embossed structure is produced. In principle it is also possible that the procedure steps are provided in reverse order. Here the coating preferably is printed or transferred to the substrate by the thermal transfer method. The coating can be produced with any printing method, such as for example by planographic printing, e.g. by offset method, by relief printing, e.g. by letterpress printing method or flexographic printing method, by screen printing, by gravure printing, e.g. by halftone gravure or intaglio printing, or by a thermographic method.

For producing the embossed structure any desired methods are thinkable likewise. Preferably, the embossed structure is produced by means of an embossing tool, which for example may be an intaglio printing plate. Here the embossing is produced as a blind embossing with the help of an inkless intaglio printing plate. But according to a special embodiment the embossed structure likewise can be produced by means of ink-carrying intaglio printing. This manufacturing variant in particular is suitable for those embodiments, in which a further ink layer congruent to the embossed structure is provided.

For producing the embossing tool, for example, a plate surface is milled with a graver or a laser. As a plate surface any material such as copper, steel, nickel or the like can be used. The graver used for the milling preferably has a flank angle of about 40° and a rounded head approximately the form of a spherical segment or spherical sector. The embossing tool can be milled as a single copy or already as a multiple-copy sheet.

In principle the order of the two procedure steps can be selected in any fashion. Normally at first the coating is applied and then it is embossed. With that the relief height and the form of the embossing is spared further influences, which for example may occur in a subsequent printing process. The alternative, namely to emboss at first and to apply the coating afterwards, however, offers the advantage of a higher color brilliance and a sharper contour of the print. This effect is caused by the fact that the substrate during the embossing process at the same time is calendered and thus a smoother, less absorbent surface is obtained.

With reference to the following examples and complementing Figures the advantages of the invention are explained. The described individual features and embodiments described in the following are inventive when taken alone, but also in combination are inventive. The examples represent preferred embodiments to which, however, the invention shall not be restricted in any fashion. The proportions shown in the Figures do not correspond to the dimensions present in reality and exclusively serve for the improvement of clarity.

DETAILED DESCRIPTION OF THE PREFERRED EMBODIMENTS

Figure 1:
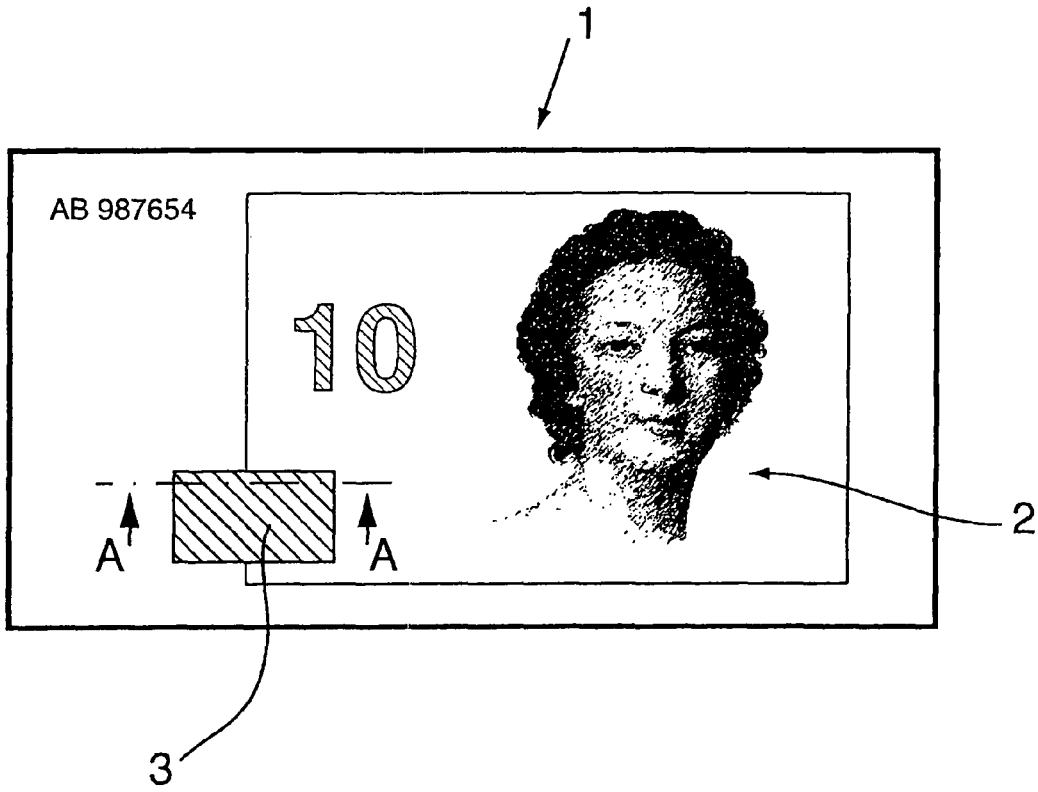
FIG. 1 shows a data carrier according to the invention.

FIG. 1 shows a data carrier 1 according to the invention in the form of a bank note with an optically variable structure 3, which is placed in the printed image area 2 of the data carrier 1 and in the printfree area. According to the invention the optically variable structure 3 is used as a so-called human feature, i.e. a feature checkable by a person without aids, possibly alongside other features for ascertaining the authenticity of the data carrier. It is especially useful to provide such features in bank notes, but also in other money-equivalent documents such as share certificates, checks and the like. Data carriers within the scope of the invention also include labels, passports or cards like those used today e.g. for identifying persons or goods or for carrying out transactions or services.

The optically variable structure 3 can be of different design resulting in the different effects from different viewing directions. According to a preferred embodiment the optically variable structure 3 consists of a single-colored or multicolored coating contrasting to the surface of the data carrier, such as a pattern, image or an alphanumeric information, which is produced by printing or in another way, such as for example by means of a transfer method. The effects according to the invention usable for determining the authenticity are produced by the embossed structure cooperating with the coating depending on the structure of coating and embossed screen and their mutual allocation.

All structures according to the invention have in common that they and the effects resulting thereof cannot be imitated with the help of reproduction techniques known today, in particular copying machines, since the copying machines can reproduce the optically variable structure only from one viewing direction, so that the optically variable effect is lost.

In the following, examples of various preferred embodiments of the invention will be explained with reference to the Figures. The representations in the Figures are greatly schematized for clarity's sake and do not reflect actual constructions.

The embodiments described in the following examples are reduced to the essential core information for clarity's sake. In practical application substantially more complex patterns or images in single-color or multicolor printing can be used as a coating. The same applies to the embossed structures. The information represented in the following examples can likewise be replaced by image information or text information as elaborate as desired. For producing the coating, e.g. as an imprint, usually the possibilities of the printing technology are exploited. Typically, pattern elements with minimum diameters of 10 micron are used. The nonlinear embossed elements, which form the embossed structure, as a rule have an embossing height in the range of 20 to 250 micron and preferably a diameter in the range of 40 to 1000 micron.

The various embodiments are not restricted to being used in the described form, but can also be combined with one another to enhance the effects.

Furthermore, in the following examples only design and mutual coordination of the embossed structure and the coating are shown, so as to illustrate the optical effects of the optically variable structure according to the invention.

Example 1

FIG. 2 to 13

Figure 2:
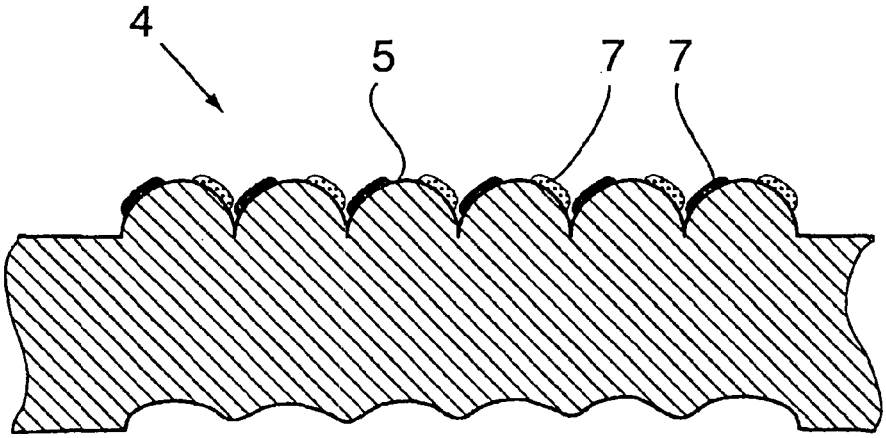
FIG. 2 shows a section along the line A-A of FIG. 1.
Figure 3:
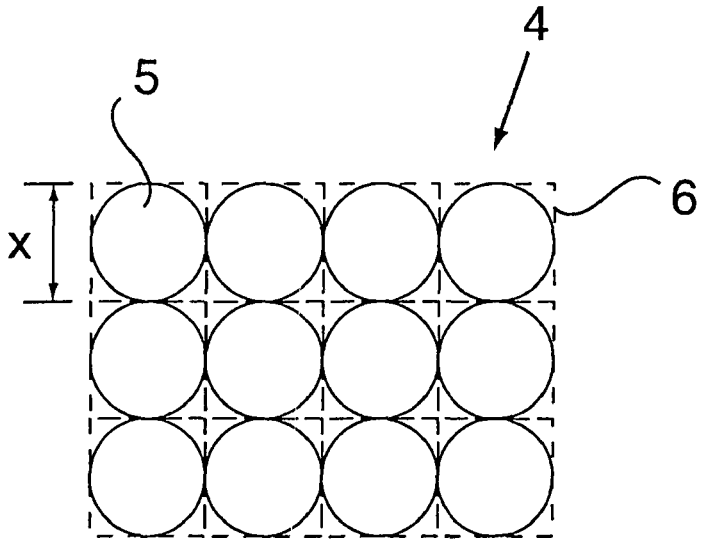
FIG. 3 shows an embossed structure according to the invention in top view.
Figure 4:
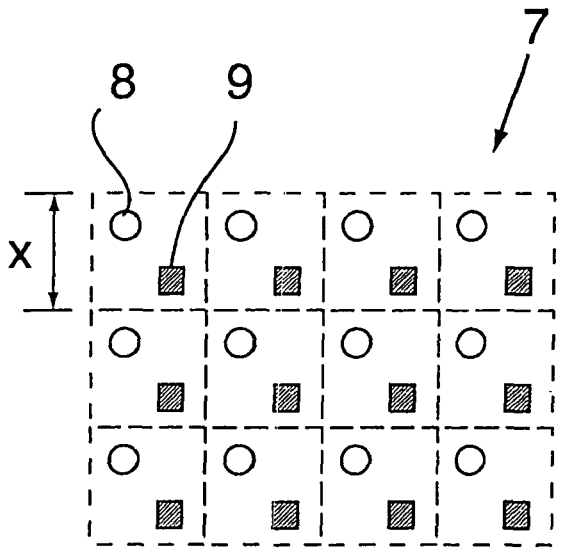
FIG. 4 shows a coating according to the invention in top view.
Figure 5:
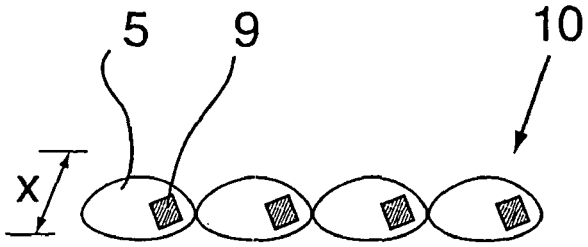
FIG. 5 shows a perspective view of an optically variable structure according to the invention, consisting of the elements represented in FIGS. 3 and 4, FIG. 6*a,b* show an embossed element in the form of a tetrahedron, FIG. 7*a,b* show a four-sided pyramidal embossed element, FIG. 8*a,b* show an embossed element in the form of a frustum of a pyramid, FIG. 9*a,b* show an embossed element in the form of a frustum of a cone, FIG. 10*a,b* show an embossed element in the form of a cylinder segment, FIG. 11*a,b* show an embossed element in the form of a torus, FIG. 12*a,b* show an oval embossed element, FIG. 13*a,b* show a drop-shaped embossed element.

FIG. 2 schematically shows a sectional view along the line A-A (cf. FIG. 1) and in conjunction with FIGS. 3, 4 and 5 an optically variable structure, wherein the embossed structure 4 is formed by regularly disposed, uniform nonlinear embossed elements 5, i.e. as a periodical screen. The nonlinear embossed elements 5 are provided with a coating 7, which is formed as a multicolored pattern, the individual colored areas of which are located on the flanks of the nonlinear embossed elements.

That the nonlinear embossed elements 5 are designed as elevations, which preferably are produced by embossing the data carrier, is clearly recognizable at the top side of the data carrier as shown in the sectional view. If the data carrier is mechanically shaped with an embossing tool the bottom side of the data carrier material shows the negative deformation. The deformation here is only schematically represented. The back of the data carrier normally will not have an embossing as distinct and true to the embossing tool. In the following only the top side or front side of the data carrier, which are essential to the understanding of the invention, are viewed. The deformation of the bottom side or back is not essential to the invention, but only a concomitant of special embossing techniques, such as e.g. intaglio printing. But it can serve as a further authenticity feature.

FIGS. 3 and 4 with the help of a detail show the individual components of the optically variable structure 3 in top view. In the two Figures a dash-lined quadratic screen 6 has been drawn so as to facilitate the orientation for the viewer. The pattern repeat of the coating 7 and the frequency of recurrence of the embossed structure 4 in this example coincide with a side length X of the quadratic screen 6. As apparent from FIG. 3, the nonlinear embossed elements 5 in the shown example have the form of segments of a sphere.

In FIG. 4 the coating 7 is represented as a pattern of repetitive circular areas 8 and squares 9, wherein all circular areas 8 carry a first color, e.g. cyan, and all squares 9 a second color, e.g. magenta. To each segment of a sphere, i.e. nonlinear embossed element 5, one circular area 8 and one square 9 are allocated and form the basic pattern elements according to the invention. On each nonlinear embossed element 5 thus comes to lie one cyan-colored circular area 8 and one magenta-colored quadratic colored area 9. In relation to the nonlinear embossed element 5 the circular area 8 and the square 9 are located diagonally opposite to each other.

FIG. 5 in perspective representation shows the cooperation of the components of the optically variable structure 3 represented in FIGS. 3 and 4. The nonlinear embossed element 5 according to FIG. 3 disposed within a square and the pertinent coating 7 according to FIG. 4 here form a structural element 10. For clarity's sake merely one horizontal row of the structural elements 10 is shown.

From the viewing direction selected in FIG. 5 only the magenta-colored squares 9 are visible, which characterize the color effect of the optically variable structure 3 when viewed from this viewing direction. By a rotating motion and/or tilting motion of the data carrier 1 or the optically variable structure 3 mixed colors between cyan and magenta with different mixing ratios become visible for the viewer as well as pure magenta, the latter e.g. from a position opposite to that of the viewer according to FIG. 5. So the viewer perceives an interplay of colors. Upon perpendicular viewing the optically variable structure 3 appears uniformly to a large extent homogeneous in the mixed color of cyan and magenta.

The above described principle can also be used for more complicated pieces of image information. Here two or a plurality of images are divided into individual image points, which are disposed in such a way that the image points belonging to one image come to lie on the flanks of the same orientation. Depending on the embodiment upon perpendicular viewing only a surface of uniform color or a complete information is recognizable. Upon oblique viewing the individual images become visible.

The embossed structure 4 alternatively can have embossed elements of any other geometric shape, with each of which one special form of the effect being achieved. For example embossed elements in the form of pyramids or frustums of a cone with steeper flanks render a more contrasting effect when tilted than e.g. embossed elements in the form of flattened segments of a sphere with the same embossing height.

Figure 6A:
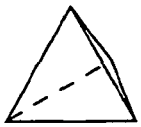
Figure 6B:
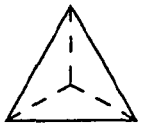
Figure 7A:
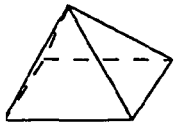
Figure 7B:
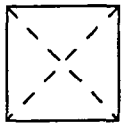
Figure 8A:
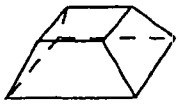
Figure 8B:
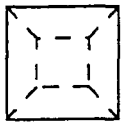
Figure 9A:
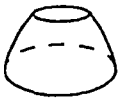
Figure 9B:
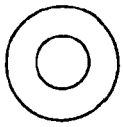
Figure 10A:
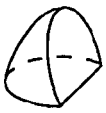
Figure 10B:
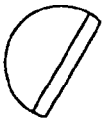
Figure 11A:
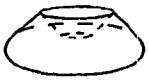
Figure 11B:
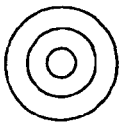
Figure 12A:
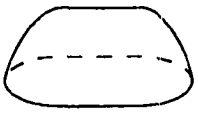
Figure 12B:
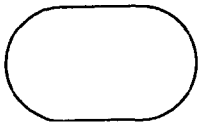
Figure 13A:
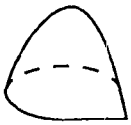
Figure 13B:
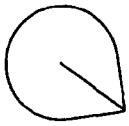

A selection of possible geometries for the nonlinear embossed elements is shown in FIG. 6(*a, b*) to 13(*a, b*). FIG. 6*a* to 13*a* show a perspective view and FIG. 6*b* to 13*b* a top view of various nonlinear embossed elements according to the invention. Without restricting the invention, embossed elements are shown which have the form of a tetrahedron (FIG. 6), four-sided pyramid (FIG. 7), frustum of a pyramid (FIG. 8), frustum of a cone (FIG. 9), spherical segment (FIG. 10), torus (FIG. 11), oval (FIG. 12) or a drop (FIG. 13).

For security paper, such as for example cotton vellum paper, nonlinear embossed elements in the form of segments of a sphere with a diameter in the range of 40 to 1000 micron, in particular between 100 to 600 micron, especially preferred between 470 to 530 micron, have proved to be particularly advantageous. The embossing height here is in the range of 20 to 250 micron, in particular in the range of 50 to 120 micron.

For the width and embossing height of oval embossed elements applies the same, with respect to the length dimensions of up to 2 centimeter have been successfully used.

Depending on the substrate material, such as thin paper or thick cardboard, plastic materials and plastic composites, such as paper laminated or coated with plastics or multilayer composite materials, certain forms and dimensions of embossed elements may be particularly advantageous. The advantageous ranges of values here actually may considerably differ from the values ascertained for security paper.

The production of the nonlinear embossed elements preferably is effected by mechanical shaping the data carrier material. For this purpose an embossing tool according to the invention is employed, which is manufactured with an engraving tool according to the invention. Until now a graver has proved to be especially suitable, the head of which is adjusted to the special requirements by the head being flattened. This adjusted engraving tool preferably has a flank angle of about 40°.

The producible geometries of the embossed elements are dependent on the employed engraving tool. If instead of a graver for example laser engraving is selected as a method for producing the embossing tool, geometries of embossed elements can be produced which have side faces perpendicular to the data carrier level. For example cylindrical embossed elements can be produced with the help of laser engraving.

Example 2

Figure 14:
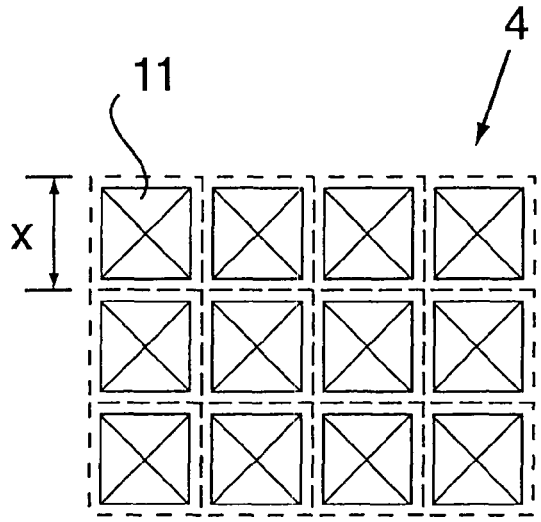
FIG. 14 shows an embossed structure made of pyramidal embossed elements in top view.
Figure 15:
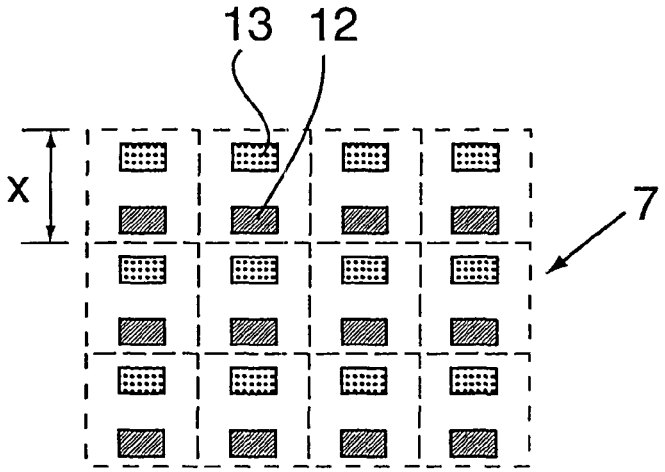
FIG. 15 shows a coating according to the invention in top view.
Figure 16:
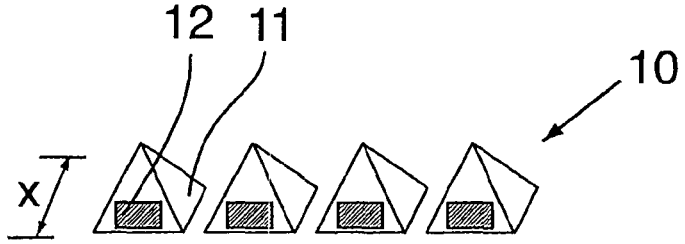
FIG. 16 shows a perspective view of an optically variable structure according to the invention consisting of the elements represented in FIGS. 14 and 15.

FIGS. 14, 15 and 16

FIG. 14 shows another embodiment of the embossed structure 4 according to the invention in top view, wherein the nonlinear embossed elements 11 consist of four-sided pyramids. FIG. 15 in top view shows the pertinent coating 7 according to the invention. It consists of regularly disposed rectangles 12, 13 of different colors. Two differently colored rectangles 12,13 together form a basic pattern element and as such belong to a structural element 10 and are disposed such that they are disposed on opposite flanks of the pyramidal embossed elements 11. FIG. 16 shows the perspective view of a row of structural elements 10, in each of which the rectangle 12 is recognizable.

Upon perpendicular viewing depending on the dimension of the rectangular areas the viewer again perceives a uniform plane color effect or directly the rectangular areas. When rotating and/or tilting the data carrier again an interplay of colors emerges.

Example 3

FIG. 17

Figure 17:
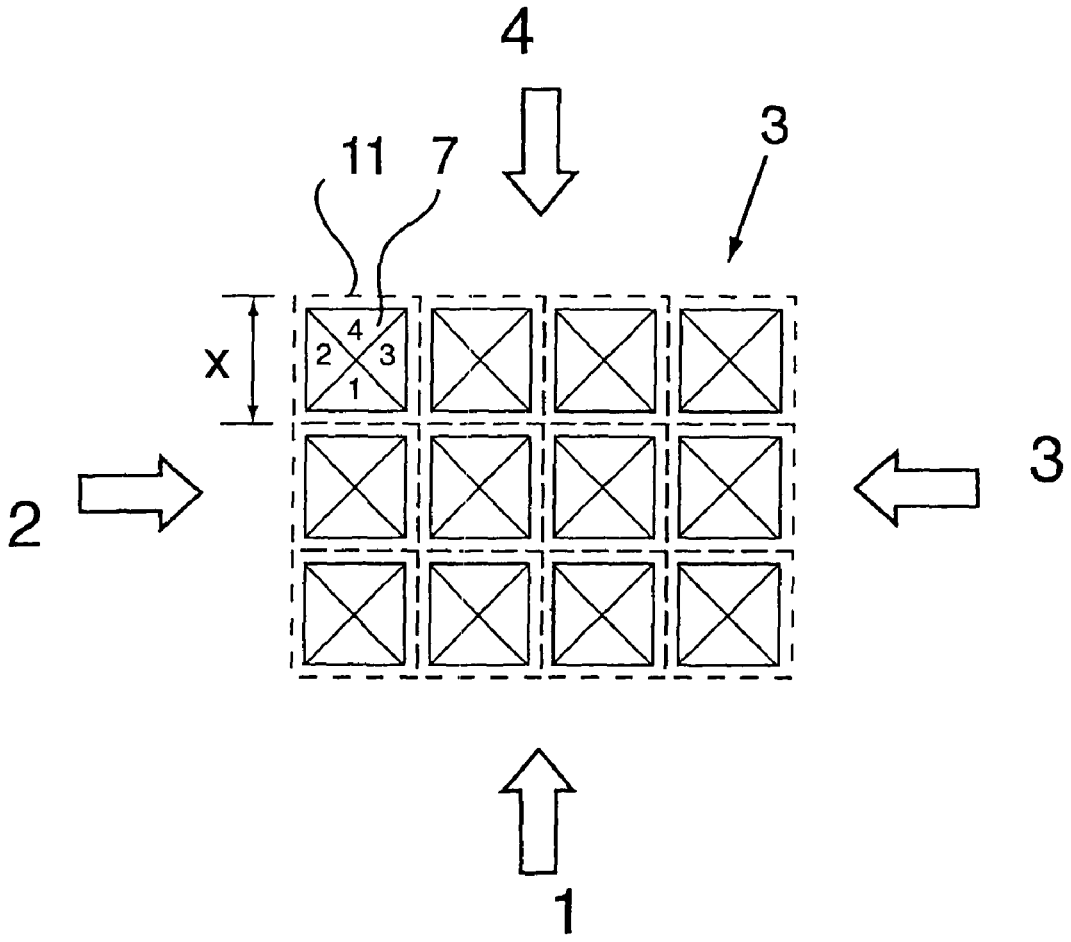
FIG. 17 shows an optically variable structure according to the invention in top view.

A further variant of the principle according to the invention explained in example 2 is shown in FIG. 17. The optically variable structure 3 has four different images, which each are recognizable when viewed from the viewing directions marked with arrows 1, 2, 3, 4. The pertinent embossed structure as in example 2 consists of four-sided pyramids 11. The coating 7 according to the invention consists of basic pattern elements which have a basically identical structure.

A basic pattern element is composed of four triangles, wherein in each of the triangles is disposed an image part of one of the four images. The triangle referred to as "1" belongs to the image recognizable under viewing direction 1, the triangle "2" to the image recognizable under viewing direction 2 etc.

If all image parts are represented in the same color, upon perpendicular viewing no image information whatsoever is recognizable. In the case of a colored embodiment an image information is possibly recognizable, which however differs from the images recognizable under the different viewing directions.

Example 4

Figure 18:
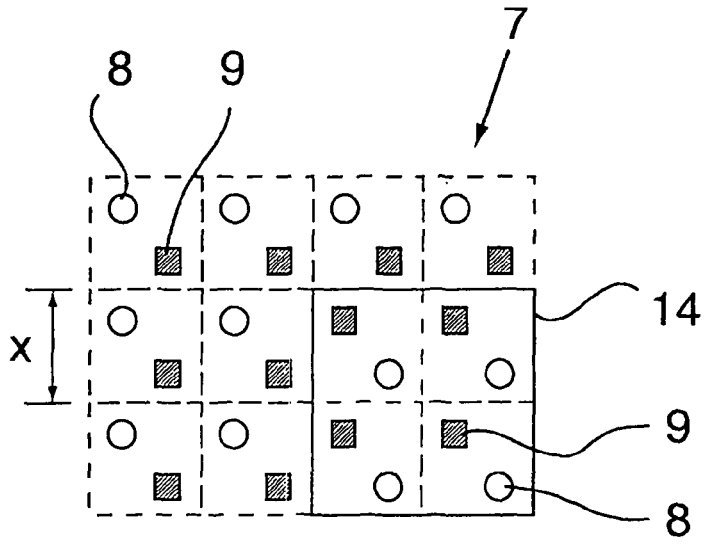
FIG. 18 shows a coating according to FIG. 4 in top view with a partial pattern area.
Figure 19:
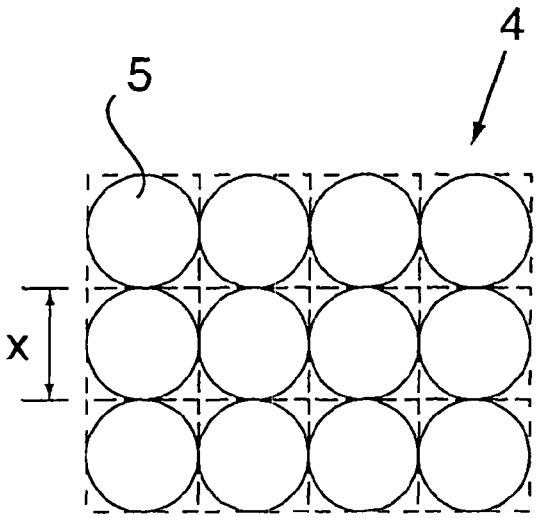
FIG. 19 shows an embossed structure corresponding to FIG. 3 in top view.
Figure 20:
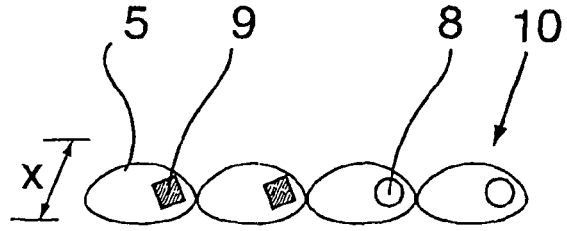
FIG. 20 shows a perspective view of an optically variable structure according to the invention consisting of the elements represented in FIGS. 18 and 19.

FIGS. 18, 19 and 20

By a special design of the coating and/or the embossed structure into the optically variable structure 3 can be incorporated an additional information, which in a viewing direction perpendicular to the data carrier level is not visible or only very faintly visible, upon oblique viewing, however, it is easily recognizable for the viewer. This information cannot be reproduced with the conventional reproduction techniques and thus enhances the forgery-proofness of a data carrier equipped in such a way.

Example 4 describes the incorporation of such an information 14 into the optically variable structure 3 by variation of the coating 7.

The basis is the coating 7 according to example 1, wherein for individual structural elements 10 the arrangement of the circles 8 and rectangles 9 has been altered. In FIG. 18 this information area is marked by the continuous edge line 14. Here the circles 8 and the rectangles 9 have been interchanged.

The FIG. 19 again shows the periodical embossed structure 4 with embossed elements 5 in the form of segments of a sphere.

FIG. 20 in perspective view shows a joint consideration of the coating 7 and embossed structure 5 represented in FIGS. 18 and 19. For clarity's sake only the middle row of structural elements 10 is shown. In the area on the right under an oblique viewing angle the viewer sees cyan-colored circular areas 8, in the left area he perceives the magenta-colored squares 9.

By a respective design and arrangement of any desired number of such altered structural elements, information of any design is representable. For example letters, company logos, check digits or decorative elements can be incorporated as an information. The coating in the area of individual structural elements can also be completely omitted or can be replaced by any pattern or information contrasting to the surroundings.

Example 5

Figure 21:
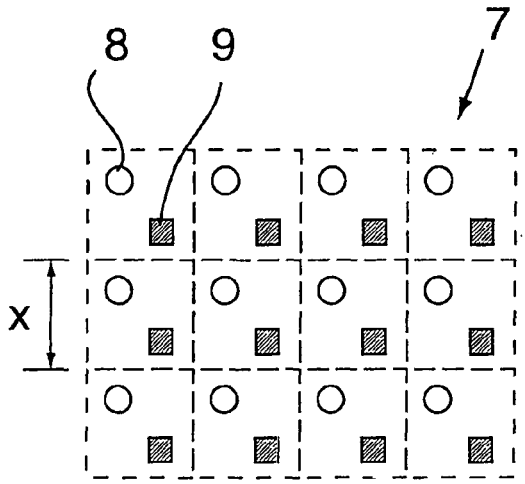
FIG. 21 shows a coating according to FIG. 4 in top view.
Figure 22:
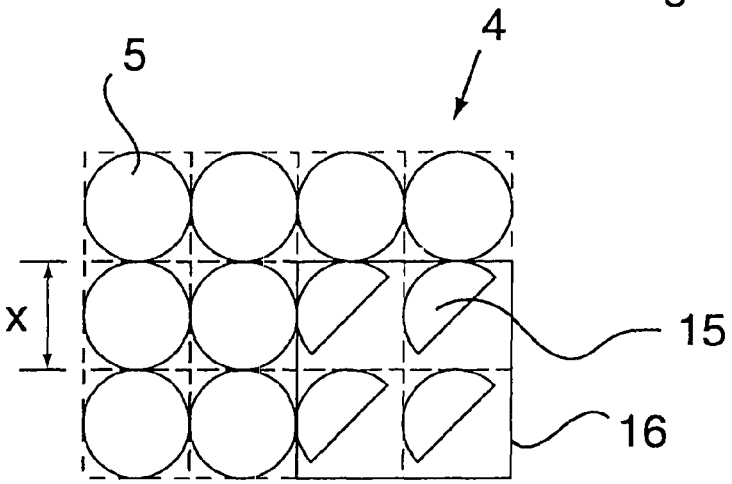
FIG. 22 shows an embossed structure according to FIG. 3 with a partial embossed structure.
Figure 23:
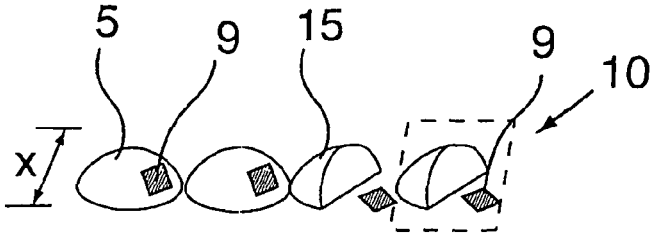
FIG. 23 shows a perspective view of an optically variable structure according to the invention consisting of the elements represented in FIGS. 21 and 22.

FIGS. 21, 22 and 23

This example shows the incorporation of an information by variation of the embossed structure.

FIG. 21 shows the coating 7 of example 1.

FIG. 22 shows an embossed structure 4 in top view, which consists of different nonlinear embossed elements 5, 15. The greatest part of the embossed structure 4 consists of embossed elements 5 in the form of segments of a sphere, as already shown in example 1. In the area of the information 16, which is marked by the continuous edge line, the embossed elements 15 have the form of spherical segments.

In the perspective representation of FIG. 23 one can recognize, that in the area 16 an essential part of the coating (here it is the magenta-colored square 9 of the coating) comes to lie in the valleys between the elevations. Since the colored areas 9 in the valleys under certain viewing angles are substantially more shadowed by the surrounding embossed elements than the colored areas 9 on the flanks of the embossed elements 5 in the form of segments of a sphere, in this way an information can be represented, which clearly emerges under certain viewing conditions.

Example 6

FIG. 24

Figure 24:
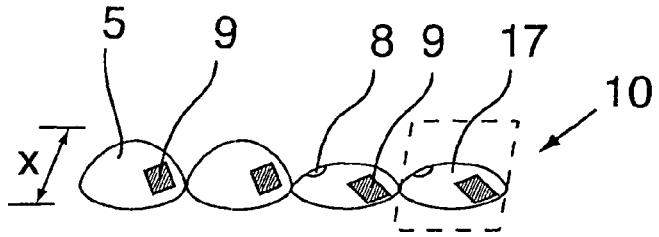
FIG. 24 shows a further embodiment of the optically variable structure with a partial embossed structure.
Figure 25:
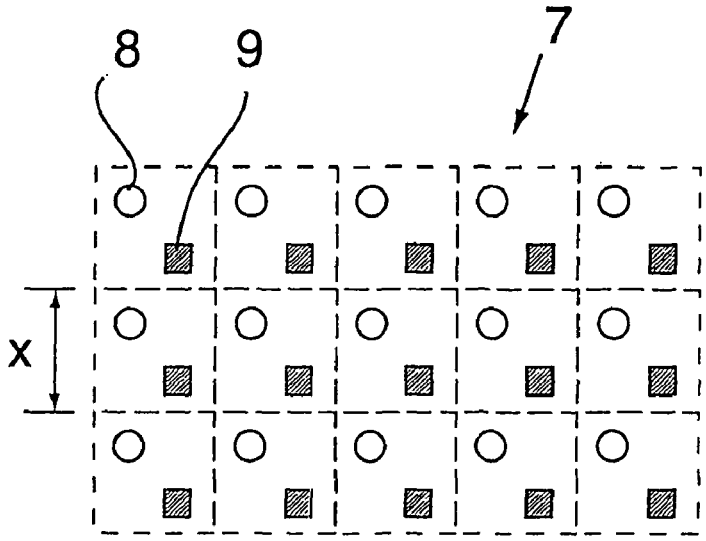
FIG. 25 shows a coating according to FIG. 4 in top view.

FIG. 24 shows a further alternative for producing an information 16 by variation of the employed geometries of the embossed elements. In this case segments of a sphere of different height 5,17 are used as embossed elements. The coating 7 in this example corresponds to that represented in FIG. 21. The embossed structure likewise is designed analogously to the structure represented in FIG. 22. Only the spherical segments represented in FIG. 22 in the area of the information 16 have been replaced by segments of a sphere, the height of which is lower than that of the surrounding segments of a sphere 5.

FIG. 24 shows such a row of structural elements 10. Due to the altered flank angle and the lower height of the embossed elements 17 in this area both the rectangles 9 and parts of the circular areas 8 are recognizable. From a perspective as shown in FIG. 24 in the area of the information 16 can be seen a mixed color between cyan (circular area 8) and magenta (square 9), while in the area of the embossed elements 5 merely the magenta-colored squares 9 are recognizable. In this' way again one piece of information can be represented.

Example 7

FIGS. 25, 26, 27

Figure 26:
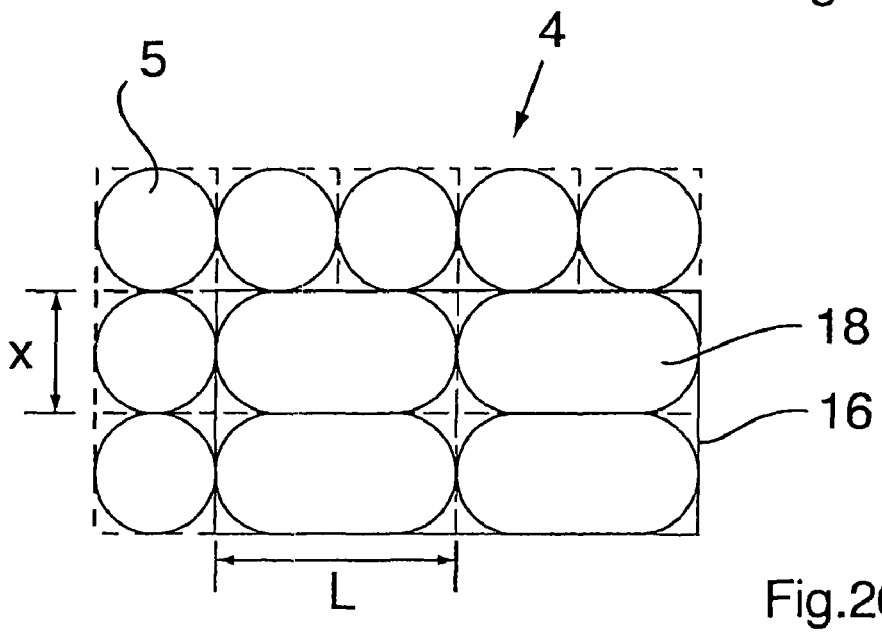
FIG. 26 shows an embossed structure according to FIG. 3 with a partial embossed structure.

A further possibility to form an information 16 by variation of the embossed structure 4 is shown in FIG. 26. Here oval embossed elements 18 are used. The length L of these oval embossed elements 18 is twice as long as the embossed elements 5 disposed outside the area 16. Accordingly, in this embodiment the structural elements 19 located in the information area 16 likewise have twice the length L, although the periodicity of the coating 7 remains the same over the entire optically variable structure. In the case of security paper the length L can amount to up to 2 centimeter.

In the field of product protection and in the field of packaging due to the substrates employed, such as plastic foils, cardboards or paper with properties strongly varying from the security paper, completely different embossed element geometries may prove to be advantageous, in particular substantially longer oval embossed elements are thinkable. In the field of packaging also patterns with a higher number of colors are widely used, which for example are produced by 8-color-printing.

Figure 27:
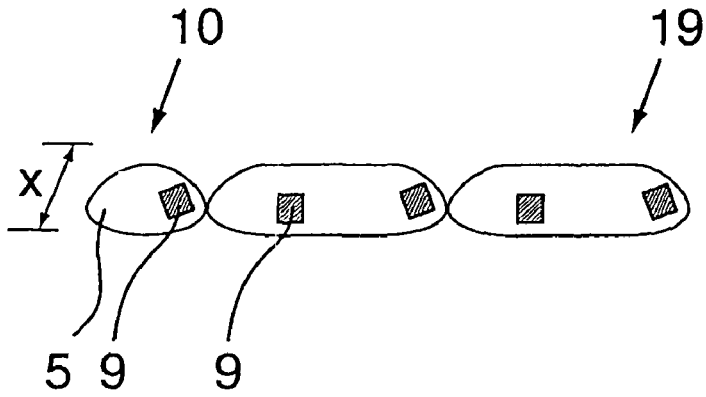
FIG. 27 shows a perspective view of an optically variable structure according to the invention consisting of the elements represented in FIGS. 25 and 26.

As explained above, the embossed structure 4 of the coating 7 is overlaid. FIG. 27 shows the middle row of the structural elements 10, 19 produced by overlaying in perspective view. The structural elements 19 forming the information area 16 consist of oval embossed elements, on which are disposed two magenta-colored squares 9 and two cyan-colored circles 8 (not showri in the Figure). Due to the special form of the embossed elements 18 the orientation of the squares 9 changes in relation to the viewing direction. This change is perceived as a contrast in color to the surroundings by the viewer and thus the information 16 becomes recognizable for the viewer.

Example 8

Figure 28:
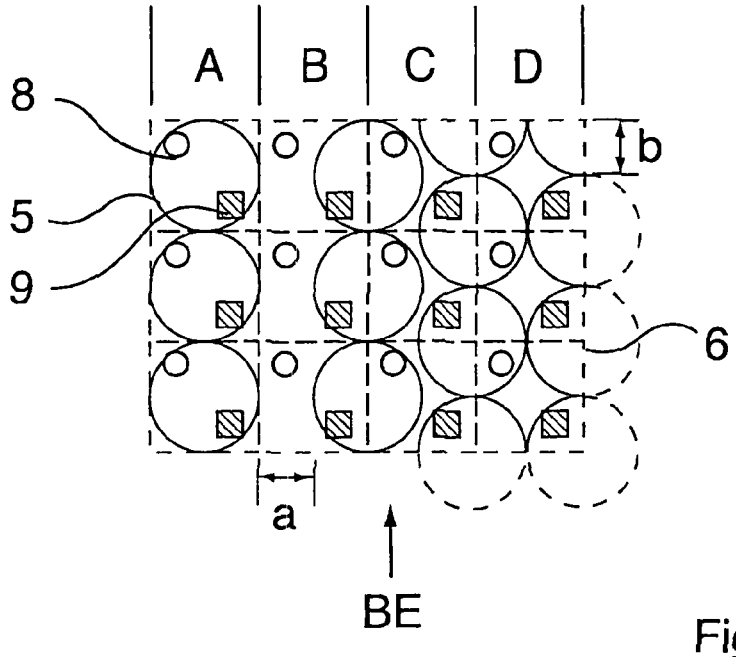
FIG. 28 shows an embodiment of the optically variable structure in top view.
Figure 29:
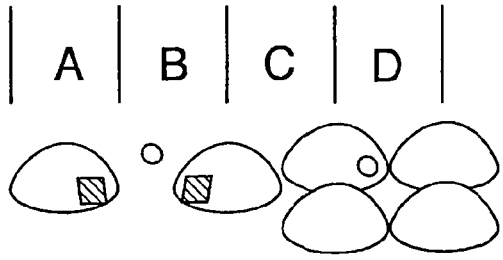
FIG. 29 shows a perspective view of a detail of the optically variable structure represented in FIG. 28.

FIGS. 28 and 29

In this example an information is produced by offsetting the nonlinear embossed elements.

The coating 7 is identical with the coating explained in example 1 and consists of basic pattern elements, which each contain one colored square 9 and one colored circle 8. The embossed structure consists of embossed elements 5 in the form of segments of a sphere.

FIG. 28 schematically shows the coating formed by the squares 9 and circles 8 as well as the embossed elements 5 in top view. As to illustrate the offset of the embossed elements, the basic pattern elements are represented in a dash-lined quadratic screen 6. This screen 6 corresponds to the repeat of the basic pattern elements. In column A of this quadratic screen 6 the embossed elements 5 have the same repeat as the basic pattern elements and are disposed such, that all circles 8 and all squares come to lie on the flanks of the embossed elements 5. In column B of the quadratic screen 6 the embossed elements 5 are offset to the right by the distance a. In this way only the squares 9 lie on the flanks of the embossed elements 5. In the column C and D of the quadratic screen 6 the embossed elements 5 additionally are offset in a downward direction by the distance b.

FIG. 29 shows a perspective view of a row of structural elements according to FIG. 28 from the viewing direction BE. For further illustration the column designations A, B, C, D are also shown. In the area of the structural elements belonging to column A the viewer perceives the squares 9. In the area of the column B the circles 8 not disposed on a flank of the embossed element 5 also contribute to the color effect of the structural element. In the area of column C and D the square 9 is located on the side of the embossed element 5 facing away from the viewer, so that the color effect mainly is determined by the circles 8.

Example 9

FIG. 30

Figure 30:
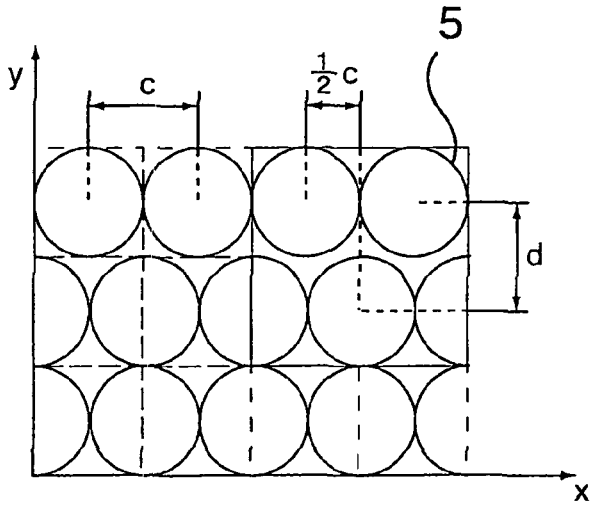
FIG. 30 shows an embodiment of the embossed structure in top view.

FIG. 30 shows further possibilities as to offset the nonlinear embossed elements. For example the distance c corresponds to the distance between the central points of two embossed elements. The embossed elements may be offset by fractions or a multiple of c or d in x direction and/or in y direction. In the above example an offset by 1.5 c in x direction and by 0.5 d in y direction has been effected.

Example 10

FIG. 31

Figure 31:
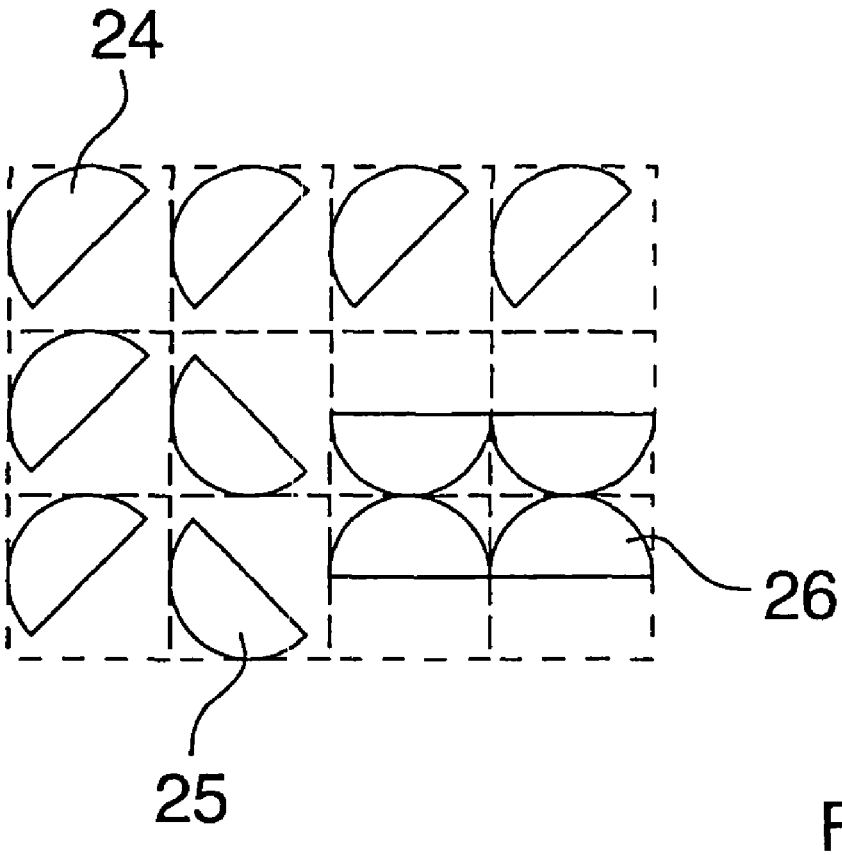
FIG. 31 shows an embodiment of the embossed structure in top view.

A further possibility for producing an information is the rotation of not rotationally symmetrical forms of embossed elements, such as e.g. an embossed element in the form of a spherical segment. FIG. 31 shows embossed elements 25 which are rotated by 90° and embossed elements 26 which are rotated by 45° against each other in the plane of projection. Other angular relationships may advantageously be employed.

One development provides to combine the rotation of the nonlinear embossed elements with a shift, i.e. an offset. The result is a wide range of possible partial embossed structures for incorporating an information.

Example 11

FIG. 32*a* to *g*

Figure 32:
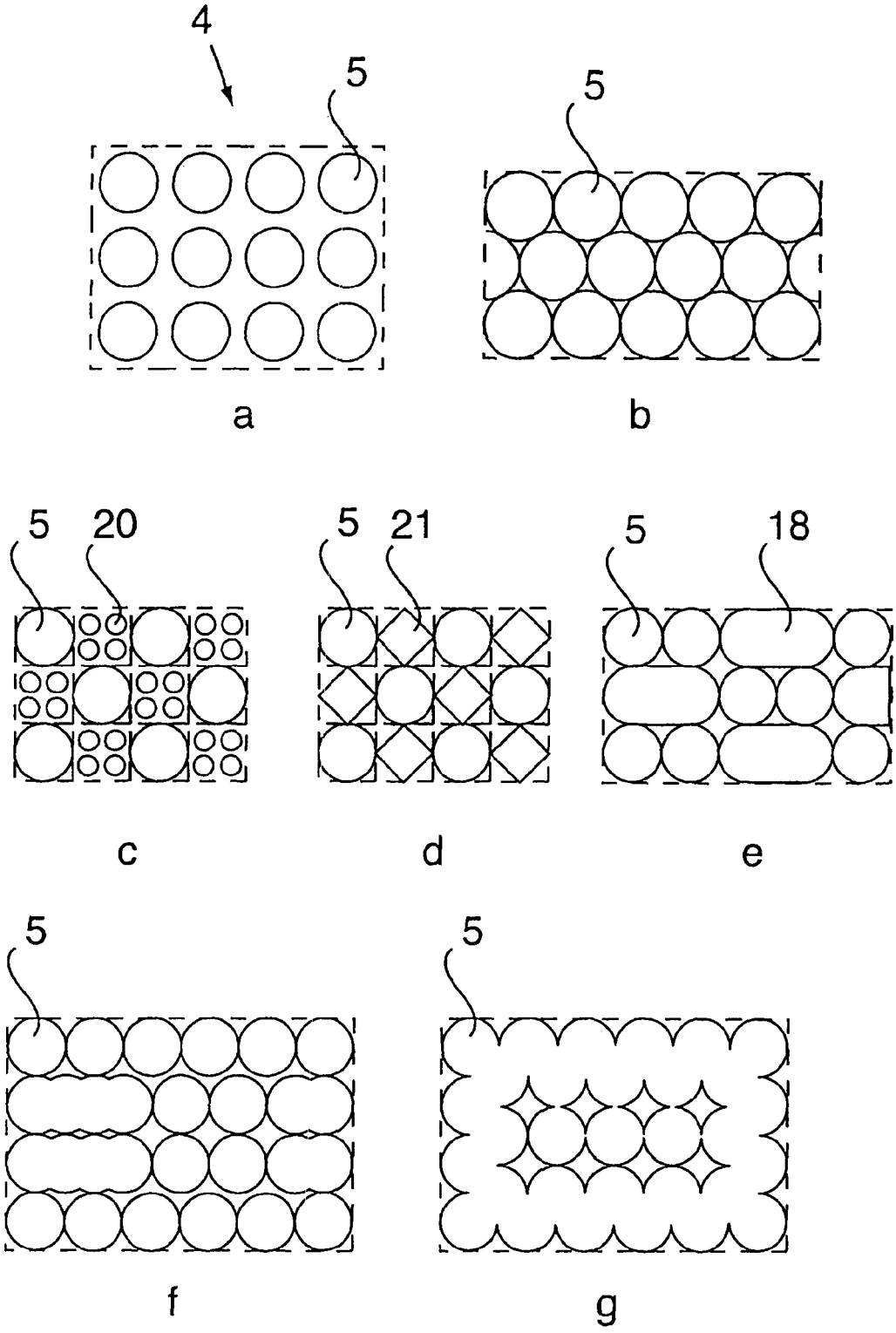
FIG. 32*a-g* show various embodiments of the embossed structure according to the invention in top view.

In FIG. 32 special embossed structures 4 are represented in top view, so as to explain the wide range of possible arrangements, embodiments and combination possibilities of the nonlinear embossed elements. These may be used for the entire embossed structure 4 or only in the area of an additional information in a form as explained with reference to the above examples.

FIG. 32*a* shows the periodical arrangement of segments of a sphere of example 1. The embossed elements 5 here are disposed at a distance. The distance may be very short, for example less than 10 micron. Especially advantageously is a distance of 2 micron between the embossed elements. Since for such a short distance the embossing tool cannot be produced with the conventional etching technology, this embodiment further enhances the forgery-proofness of the optically variable structure.

Any desired longer distances may be employed likewise. Preferred distances here are 10 to 300 micron.

FIG. 32*b* shows an arrangement of embossed elements which with regard to gaps are placed as close together as possible.

FIG. 32*c* shows an arrangement wherein segments of a sphere with a large and a small base diameter are disposed alternately. For example in the area, which takes up the base of a large embossed element 5, there is space for four small embossed elements 20.

FIG. 32*d* alternately shows embossed elements 5, 21 with a circle area and a rectangular area as a base.

FIG. 32*e* shows oval embossed elements 18 alternating with embossed elements 5 in the form of segments of a sphere. Here in the longitudinal extent of one oval embossed element 18 two embossed elements 5 are provided. In principle the oval embossed element 18 is a deformed embossed element, which originally had the form of a segment of a sphere, which has been stretched or compressed in a preferred direction.

FIGS. 32*f* and *g* show an embossed structure, wherein the embossed elements 5 in certain areas are disposed in overlap with each other, i.e. the embossed elements for example were engraved in an overlapping fashion or into each other when producing the embossing tool, so that an embossed structure in the form of a range of hills is the result.

It has been shown, that information, which is produced via a variation of the embossed structure, upon perpendicular viewing is hardly recognizable, so that in this way hidden information can be produced. Whereas changes in the coating upon perpendicular viewing normally are slightly perceptible.

A further improvement of the effect can be achieved by a suitable combination of the two possibilities for incorporating information.

Example 12

FIGS. 33, 34, 35

The coating 7 preferably has the form of a printed pattern and likewise offers a wide range of variation possibilities.

Figure 33:
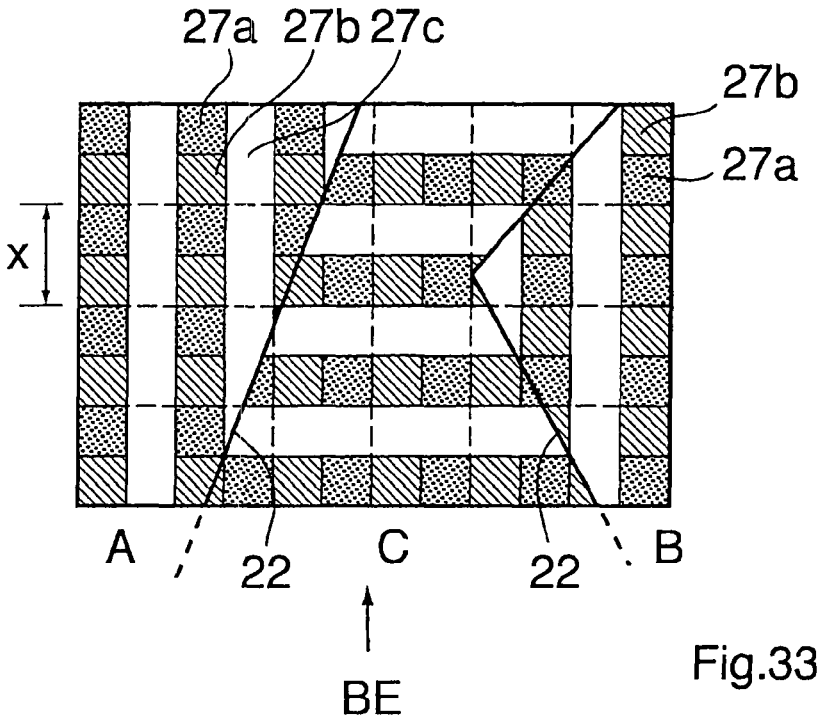
FIG. 33 shows a coating according to the invention in top view.

FIG. 33 shows a two-colored coating, which consists of squares 27*a*, e.g. magenta-colored, and 27*b*, e.g. cyan-colored. The quadratic screen 6 represented by dash lines indicates the surface, which is available for one basic pattern element. The squares 27*a*, 27*b* each occupy about a quarter of this area. The coating 7 is divided into three areas A, B, C, which can be recognized by the continuous lines 22. In the area A the squares 27*a*, 27*b* are disposed such that in a vertical direction the colors alternate and the squares adjoin each other. In a horizontal direction squares 27*a*, 27*b* of one color are disposed at a distance to each other. The space 27*c* preferably is unprinted, so that the substrate material is visible. This pattern in the following is referred to as the "basic pattern".

The partial pattern area B is produced by shifting the basic pattern by one side length of the square in vertical and horizontal direction. In this way a first information can be represented in the optically variable structure, which under certain viewing directions is visible. An interchanging of the rows and columns of the basic patterns results in a partial pattern area C, in which is represented a second information, which is well visible from another viewing angle range. The limiting lines 22 here only serve for clarity's sake, so as to be able to clearly optically separate the individual partial pattern areas A, B, C from each other.

Additionally, further partial pattern areas can be produced e.g. by a further shift by a fraction of side length of the square.

It has been shown, that by integrating a free, i.e. not or only transparently printed or coated, substrate area into the pattern, a very lively and striking interplay of colors is produced, wherein the viewer can see the information particularly well.

Figure 34:
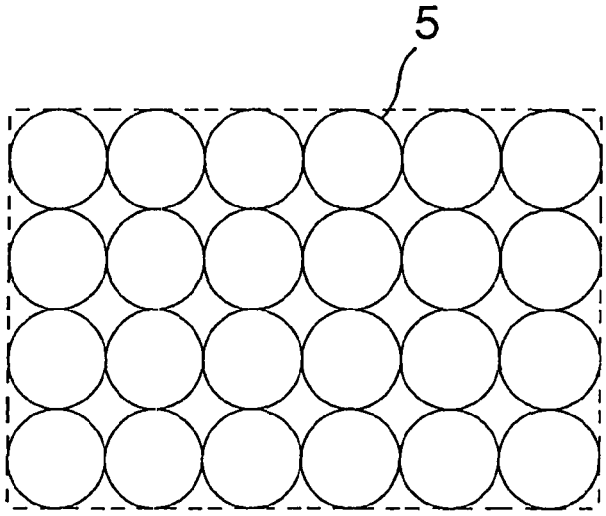
FIG. 34 shows an embossed structure according to the invention in top view.

In combination with a suitable embossed structure a complex optically variable structure is provided, which shows to the viewer various pieces of information in a plurality of various viewing angle ranges. A periodical embossed element arrangement suitable for this is shown in FIG. 34.

Figure 35:
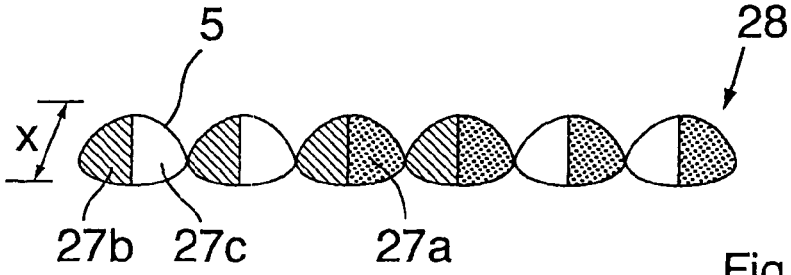
FIG. 35 shows a perspective view of the optically variable structure consisting of the elements represented in FIGS. 33 and 34.

For illustrating the different visual impressions given by the various partial pattern areas (A, B and C) from an exemplary viewing direction BE, FIG. 35 shows the second row from above of structural elements 28 of FIG. 33 in perspective view.

Examples 13 to 17

FIG. 36 to 40

FIG. 36 to 40 show structural elements 29, from which further suitable optically variable structures can be generated, in top view (a), and by way of example combined with an embossed element 5 in the form of a segment of a sphere in perspective view (b).

Figure 36:
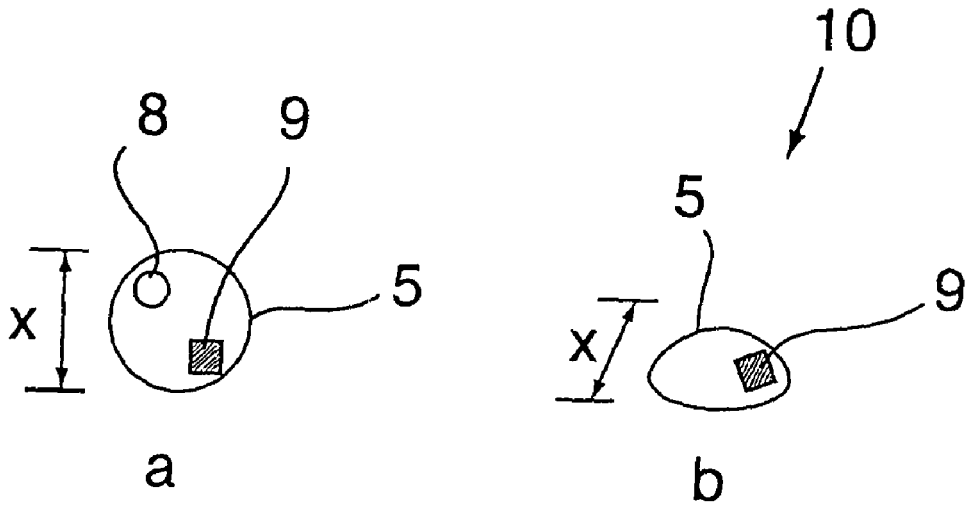
FIG. 36 shows a structural element according to the invention in top view and in perspective view.

FIG. 36 shows the structural element 10 according to example 1 in top view (a) and in perspective view (b).

Figure 37:
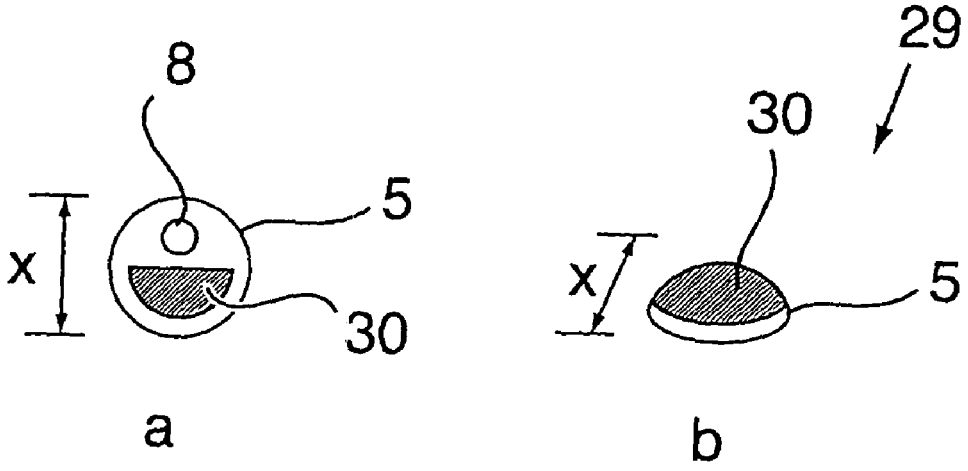
FIG. 37 shows a structural element according to the invention in top view and in perspective view.

FIG. 37 shows a structural element 29, which has a two-colored printed pattern, for example a cyan-colored circular area 8 and a magenta-colored semicircle area 30. The semicircle area 30 viewed from the perspective of FIG. 37*b* determines the color effect. When the data carrier is rotated by 180° the cyan-colored circular area 8 determines the color effect. During the rotation motion changing mixed colors can be seen.

Figure 38:
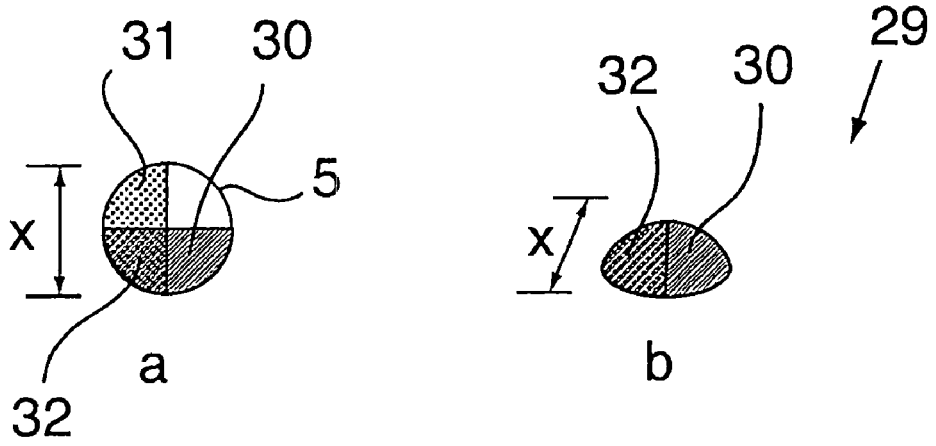
FIG. 38 shows a structural element according to the invention in top view and in perspective view.

FIG. 38 also shows a magenta-colored semicircle area 30 and a yellow semicircle area 31 partially overlapping this area. In the overlapping area 32 arises a mixed color, from which results a color effect similar to that of a pattern printed in three colors.

Figure 39:
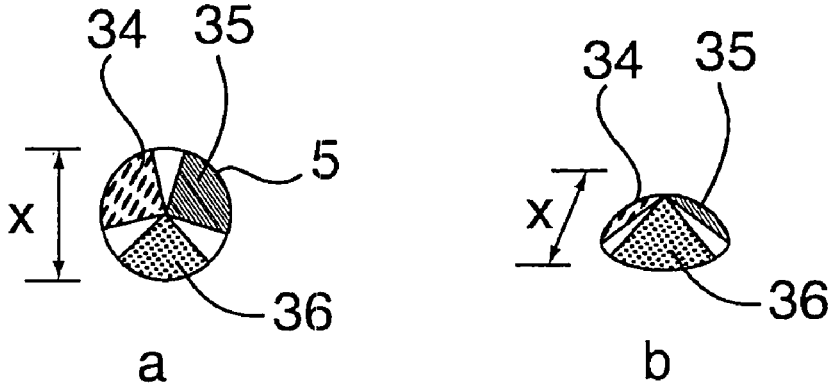
FIG. 39 shows a structural element according to the invention in top view and in perspective view.

FIG. 39 shows a three-colored basic pattern element, which is formed of sectors of a circle 34, 35, 36, which each are disposed spoke-like. In the ideal case a group of three 34, 35, 36 is placed on one knob 5. When rotated and/or tilted the colored sectors of a circle 34, 35, 36 become visible one after the other.

Figure 40:
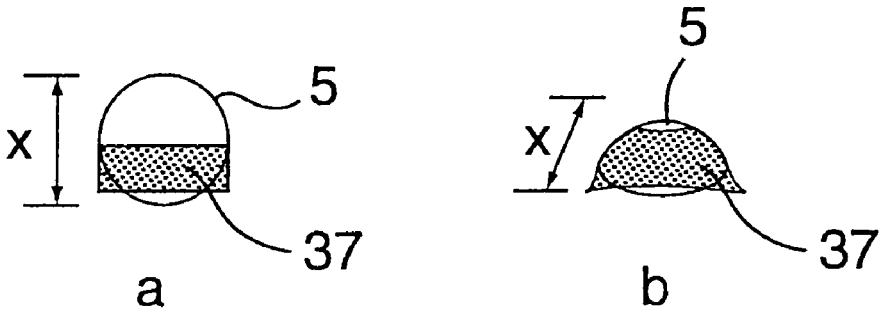
FIG. 40 shows a structural element according to the invention in top view and in perspective view.

FIG. 40 shows an embossed element 5 printed with a fragment of a stripe pattern 37. This stripe pattern 37 is printed in one color so that the viewer from the perspective of the FIG. 40*b* perceives the color of the stripe 37. Since the back of the embossed element 5 is unprinted, the viewer perceives only the color of the substrate when the viewing angle is changed by 180°. When rotating and/or tilting the optically variable element an interplay of brightness of the color tones used for the color stripes is the result. This embodiment, too, inheres an attractive, rather subdued effect.

The stripe pattern 37 likewise can have a structure of curved lines and/or can be designed in a multicolored fashion. A pattern containing guilloches is also suitable for the invention.

A further advantageous variation of the coating is a reduction or enlargement of the size of the individual colored areas of the pattern belonging to the basic pattern element, wherein preferably the pattern repeat is not changed in its dimensions. It has been shown, that in this way a very strikingly color-changing, optically variable element can be produced.

Example 18

Figure 41:
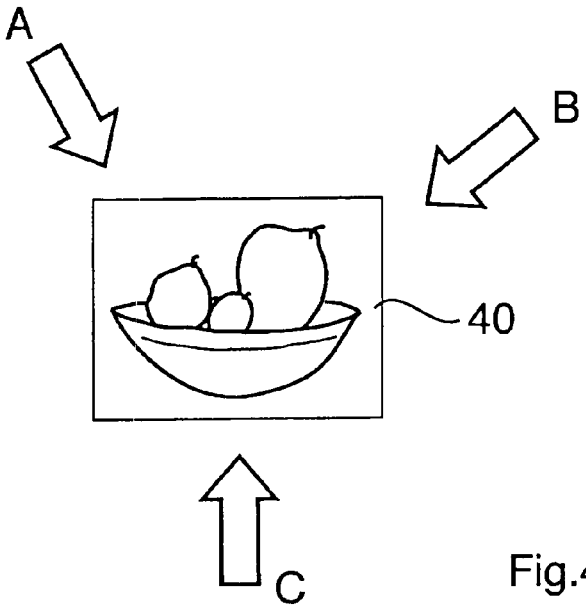
FIG. 41 shows an optically variable structure in the form of a colored image motif in top view, wherein for each of the viewing directions A, B and C a single-color representation is shown.
Figure 42:
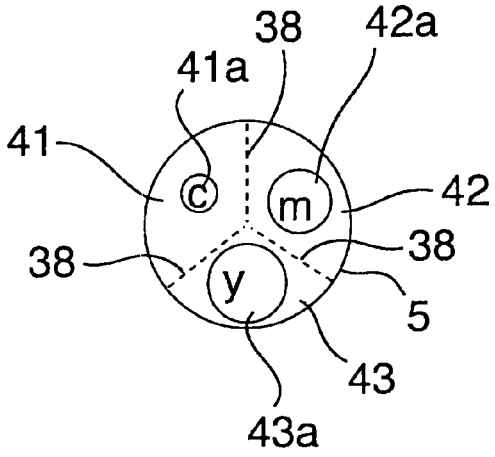
FIG. 42 shows a structural element in top view as it is used for producing the colored image according to FIG. 41.
Figure 43:
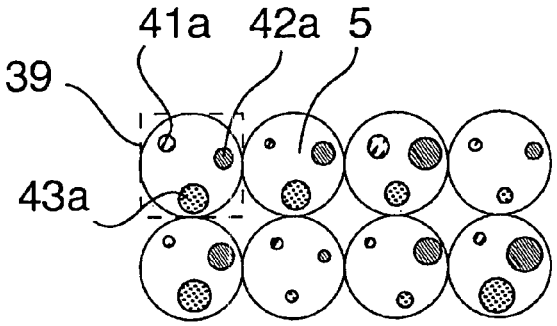
FIG. 43 shows structural elements of the optically variable structure, according to FIG. 41 in top view.

FIGS. 41, 42 and 43

The coating according to the invention according to a further embodiment instead of a simple geometric pattern can be a complicated image, which preferably is printed by multicolor printing.

FIG. 41 shows an example for an optically variable structure, in which such a colored image 40 is used. Upon perpendicular viewing the image 40 appears in the usual multicolorfulness. Upon viewing from the viewing directions A, B and C, however, one respective color prevails. For the production of this optically variable effect the image 40 is divided into pixels of equal size, and to each pixel the pertinent color components cyan, magenta and yellow are allocated. These color components in the present case are disposed in the circle segments 41, 42, 43, which in FIG. 42 are indicated by dash lines 38. The color of the pixels is adjusted by providing the circle segments 41, 42, 43 with color. The pixel represented in FIG. 42 in the circle segments 41, 42, 43, however, only in the areas 41*a*, 42*a*, 43*a* is provided with the colors cyan (c), magenta (m) and yellow (y), so that this pixel upon perpendicular viewing shows a color tone corresponding to the color mixture. The color areas 41*a*, 42*a*, 43*a* here form the basic pattern element according to the invention. In FIG. 42 at the same time is represented the projection of a nonlinear embossed element 5, so as to demonstrate how the embossed element in the ideal case is disposed relative to the circle segments 41, 42, 43. This spatial disposition of the color components cyan, magenta and yellow and the embossed element 5 is determined for the entire image 40, as apparent from FIG. 43. The embossed element 5 and the pertinent color components 41*a*, 42*a*, 43*a* therefore form a structural element 39 within the terms of the invention.

FIG. 43 shows a highly magnified detail of the image 40 in top view, so that the individual pixels or basic pattern elements and the respective pertinent color components are visible. The embossed elements 5 are schematically shown as a projection, so that it is recognizable that the nonlinear embossed elements and the pertinent color components 41*a*, 42*a*, 43*a* of the pixel form the structural elements 39. The result is, that when viewing the image 40 from the direction A (FIG. 41) the cyan components determine the image effect, while from the viewing direction B the magenta components and from the viewing direction C the yellow components will prevail. When rotating and/or tilting the optically variable element interesting color changes will arise, which cannot be imitated by other means.

It is obvious that all other imaginable color systems as well as any colors or lacquers can be employed. Instead of individual color components or all color components special lacquers can be used, which produce dull or glossy areas. An integration of dull-gloss-effects into the print may even intensify the effect of the optically variable structure. The colored areas of the basic pattern elements alternatively may also be disposed in an overlapping and/or asymmetrical and/or random-generated fashion.

Example 19

FIG. 44

With this embodiment, by especially selecting the geometry of the nonlinear embossed elements smooth and sharp transitions between the pieces of information are produced, which are visible under the various viewing angles.

Figure 44:
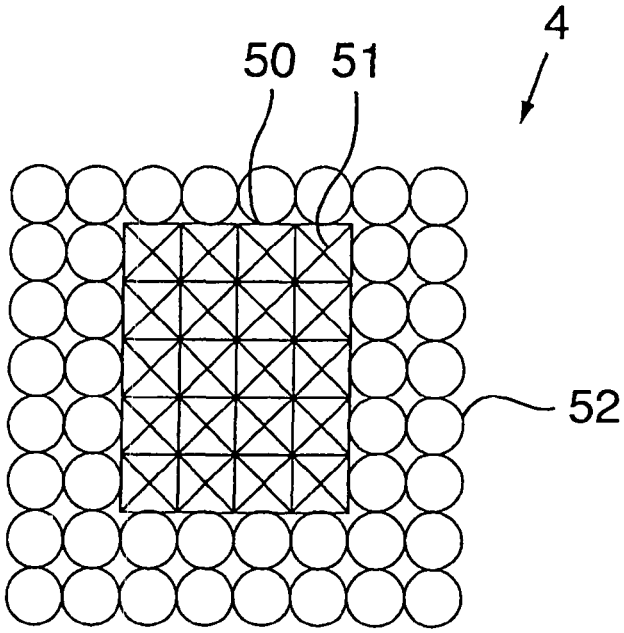
FIG. 44 shows an embossed structure according to the invention in top view
Figure 45:
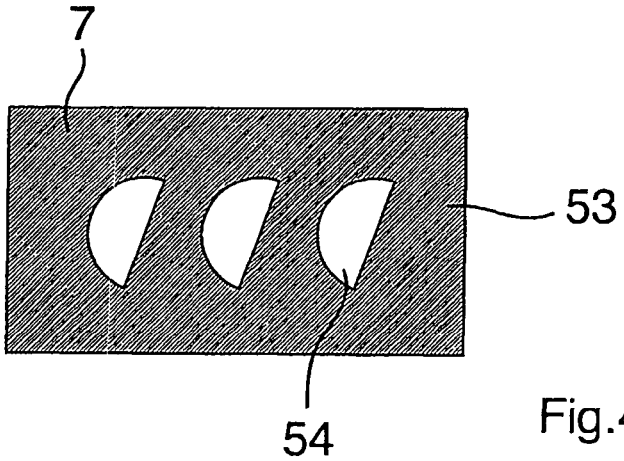
FIG. 45 shows a coating according to the invention.

FIG. 44 shows such an embossed structure in top view. It consists of a square field 50, in which four-sided pyramids 51 are disposed as nonlinear embossed elements. This field 50 is surrounded by embossed elements in the form of spherical segments 52. When rotating and/or tilting the optically variable element the sharp-edged flanks of the pyramids 51 produce a sharp transition between the individual pieces of information disposed on the flanks. While the spherical segments due to their round form produce a continual and thus smooth transition between the pieces of information.

When on the pyramidal embossed elements a single-colored image motif and on the spherical segments a multicolored background motif is disposed, upon rotating and/or tilting the security element the single-colored image motif abruptly appears and vanishes in front of a colored background, which smoothly changes from one color to another and shows, for example, a rainbow effect.

Example 20

FIGS. 45, 46

Figure 46:
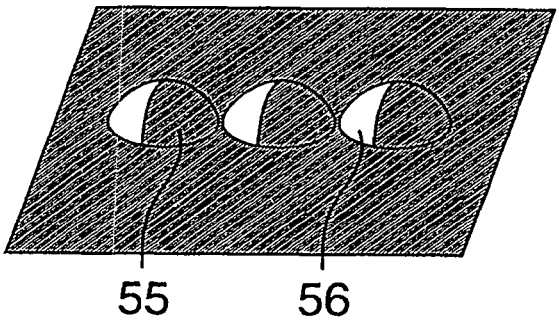
FIG. 46 shows an optically variable structure according to the invention and use of the coating according to FIG. 45.

In this embodiment the coating 7 consists of a single-color all-over background print 53, which has gaps 54 in the form of semicircles. This coating is combined with an embossed structure in the form of segments of a sphere 55, wherein the cut surfaces 56 of the segments of a sphere 55 coincide with the gaps 54 (FIG. 46). In this way it is achieved, that the gaps are recognizable only from a defined viewing direction and in a narrow angle range.

The gaps of course can have any form. The coating can also be a metal layer, which is transferred to an appropriate substrate by transfer method.

Example 21

Figure 47:
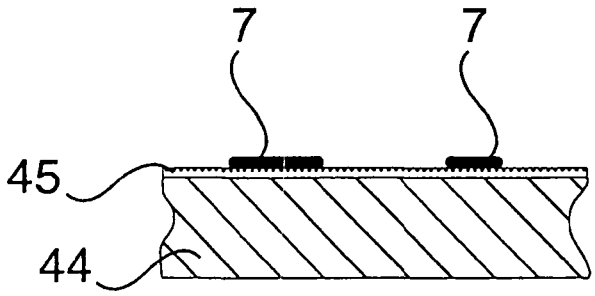
FIG. 47 shows a data carrier according to the invention in cross section before the embossing.
Figure 48:
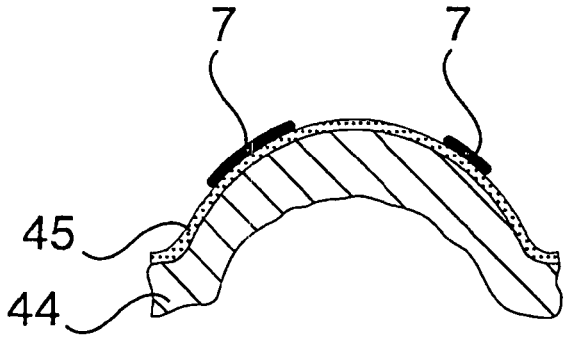
FIG. 48 shows a data carrier according to the invention in cross section after the embossing.

FIGS. 47 and 48

Preferably, the optically variable element is produced by printing technology. For this the coating is printed onto a substrate, preferably the document material, by any desired printing method, preferably by offset printing, and then this coating is appropriately embossed with an embossing tool. As an embossing tool here preferably an intaglio printing plate is used. This proceeding is represented in FIGS. 47 and 48.

FIG. 47 shows a data carrier according to the invention in cross section before the embossing process. The data carrier substrate 44 at first is printed with a background layer 45 e.g. all over. Thereon the coating 7 is applied.

The background layer 45 can also have the form of information and patterns. Special printing inks may also be used, which further enhance the antiforgery effect of the optically variable element. These can be optically variable printing inks, such as printing inks containing interference layer pigments or liquid crystal pigments, or metal effect inks, such as gold effect inks or silver effect inks.

FIG. 48 shows a sectional view of the data carrier after the embossing, which in the shown example has been produced as a blind embossing by means of intaglio printing. The embossing is positioned such that the coating 7 comes to lie on the flanks of the embossed structure.

Alternatively, the background 45 likewise can be applied by means of another method, for example in a transfer method, in an all-over fashion or provided with gaps or a pattern. By the transfer method also metallic pattern elements or coatings can be applied.

Example 22

Figure 49:
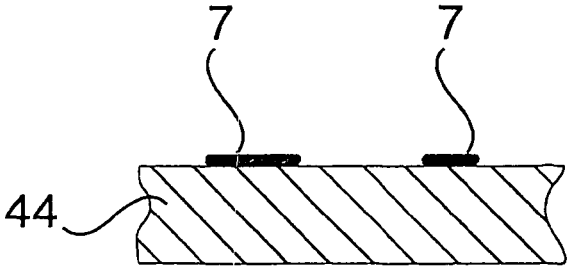
FIG. 49 shows a data carrier according to the invention in cross section before the embossing.
Figure 50:
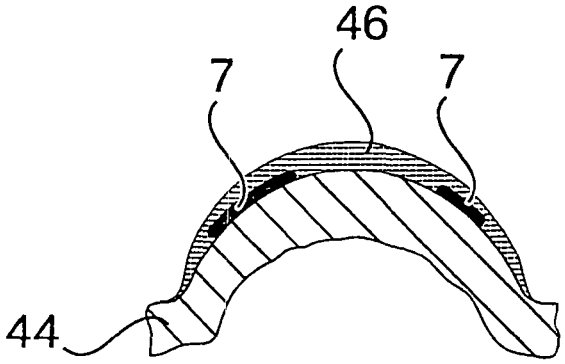
FIG. 50 shows a data carrier according to the invention after the embossing which is executed in an ink-carrying fashion.

FIGS. 49 and 50

The background layer 45 can also be completely omitted, such as shown in FIG. 49. In this case the embossing, which for example is produced by steel intaglio printing, is executed in an ink-carrying fashion.

FIG. 49 shows the structure before the embossing with substrate 44 and coating 7. FIG. 50 shows the situation after the embossing. The structure shown in FIG. 49 was embossed in an ink-carrying fashion, so that an ink layer 46 lies congruently on the embossing. The additional ink layer 46 comes to lie as a top layer, since this embossing was carried out as last procedure step.

Preferably, for the ink layer 46 an at least translucent ink is used. The ink-carrying intaglio printing in an adaptation can be executed such that an inking takes place only on the nonlinear embossed elements, the valleys between the nonlinear embossed elements however remain free of ink.

In a development for the ink layer 46 an ink with machine readable additives, such as for example luminescence substances, can be employed.

Example 23

FIG. 51 to 53

This example describes an alternative for producing the optically variable element, wherein at first the substrate material is embossed and then the embossed area is provided with the coating.

Figure 51:
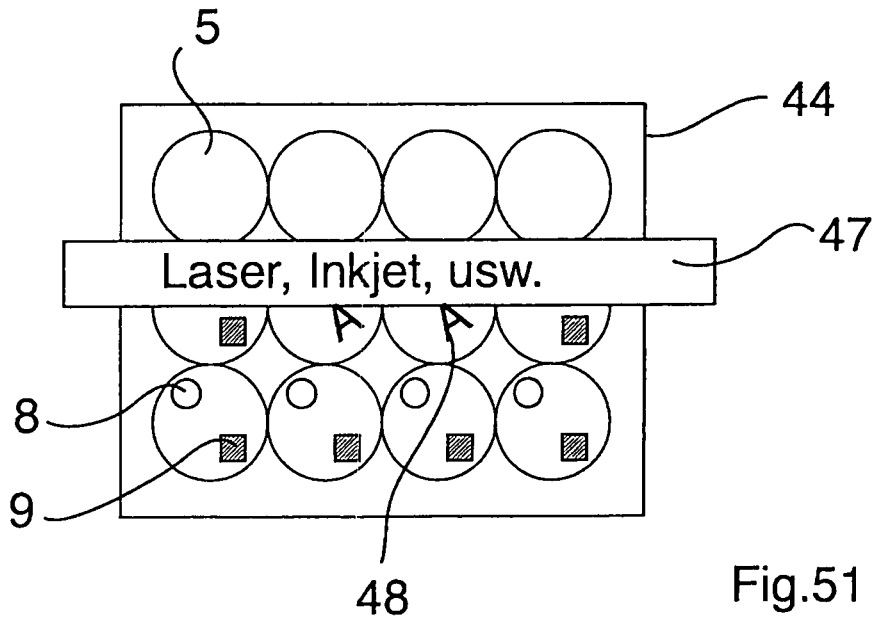
FIG. 51 shows the applying of the coating onto an embossed structure with non-contacting methods.

FIG. 51 shows a detail of a document material 44 in top view. The material 44 is provided with an embossed structure, which has periodically blind-embossed embossed elements in the form of segments of a sphere 5. This document material 44 passes a marking device 47, which has means for a non-contacting marking, such as for example one or a plurality of ink jet print heads. The marking device 47 produces the coating according to the invention on the already present embossed structure. The coating in this case consists of screenlike disposed basic pattern elements, most basic pattern elements having a circular area 8 and a square 9. In some basic pattern elements the square 9 is replaced by the information 48 in the form of the letter "A", so that the coating has an additional information 48.

Figure 52:
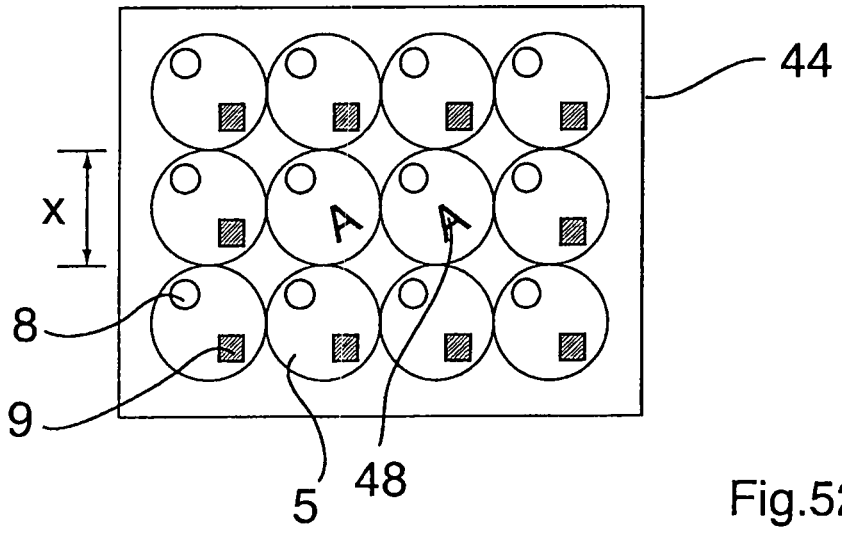
FIG. 52 shows an optically variable structure produced according to FIG. 51 in top view.
Figure 53:
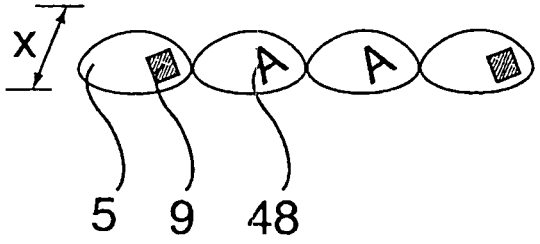
FIG. 53 shows a perspective representation of the optically variable structure according to FIG. 52.

FIG. 52 shows the finished printed substrate detail 44 in top view. In FIG. 53 is shown a perspective view of the middle row of basic pattern elements according to FIG. 52.

The marking device 47 additionally or alternatively to the ink jet print heads can have one or a plurality of laser scan heads, which write pattern elements individually selectable for each place on the embossed structure, e.g. the letters A, into the substrate of the data carrier or into a coating by applying the energy of the laser beam.

The guiding in register between embossed structure and coating can also be effected by means of register marks or by using a device for imaging and image processing. For this purpose for example zeniths or valleys of embossed elements have to be captured by the imaging and image processing device, and their positions have to be made available as input values for the control unit of the marking device.

FIG. 54 to 57 show alternative possibilities for producing the security element according to the invention, in which at first the embossed structure is produced and then the coating is applied onto the individual nonlinear embossed elements.

Figure 54:
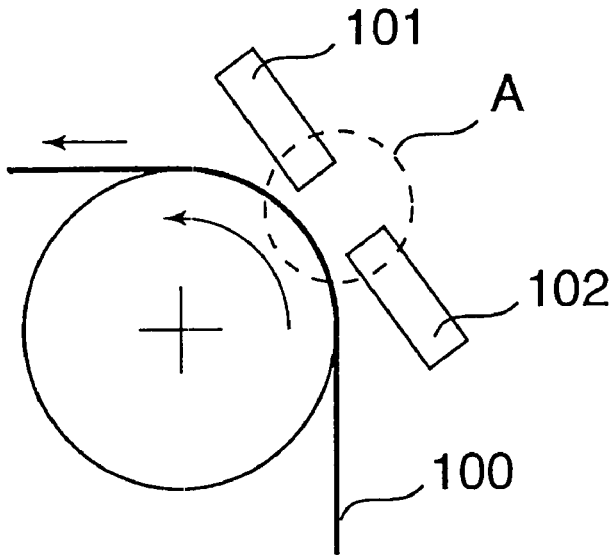
FIG. 54 shows a method for post-printing the embossed structure.
Figure 55:
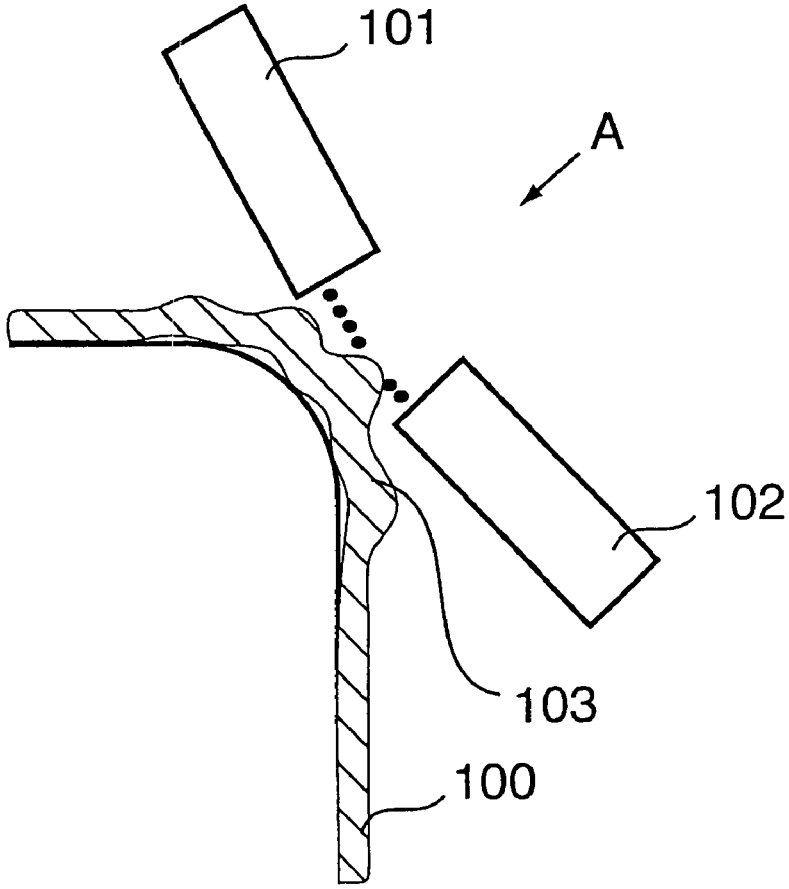
FIG. 55 shows a magnified detail A from FIG. 54.
Figure 56:
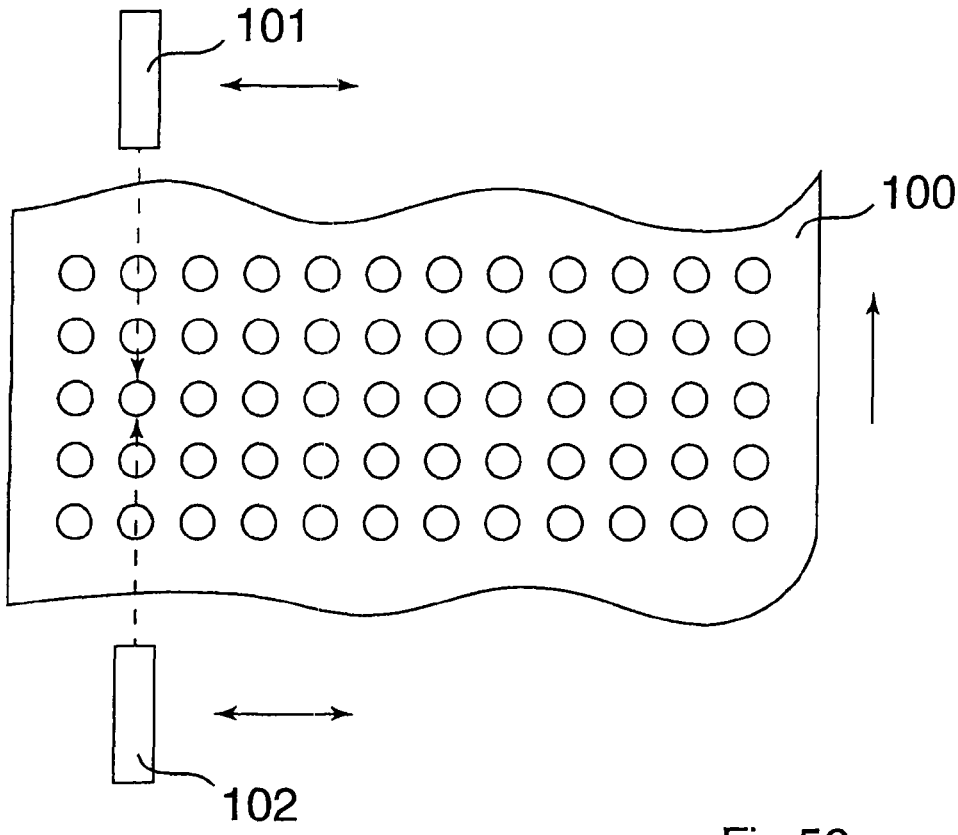
FIG. 56 shows an alternative method for printing the embossed structure.

According to FIG. 54 the already embossed substrate 100 via a roll is guided past two ink jet heads 101, 102. By the curvature of the roll the embossed structure 103 is stretched apart and slightly fanned out, so that the ink jet heads 101, 102 can print one embossed element onto each of the respective flanks. This is represented in the detail A in FIG. 55. A further possibility is shown in FIG. 56. Here the substrate 100 already provided with the embossed structure is transported in the plane. The ink jet heads 101, 102 here are disposed such that they each can print one of the nonlinear embossed elements. When one of the nonlinear embossed elements is appropriately printed, the ink jet heads 101, 102 are moved on according to the arrows as shown in FIG. 56. As soon as one line of the nonlinear embossed elements is printed, the ink jet heads 101, 102 are moved on downwards to the next line and the next line of nonlinear embossed elements can be printed.

Alternatively, of course also the substrate 100 can be moved.

Figure 57:
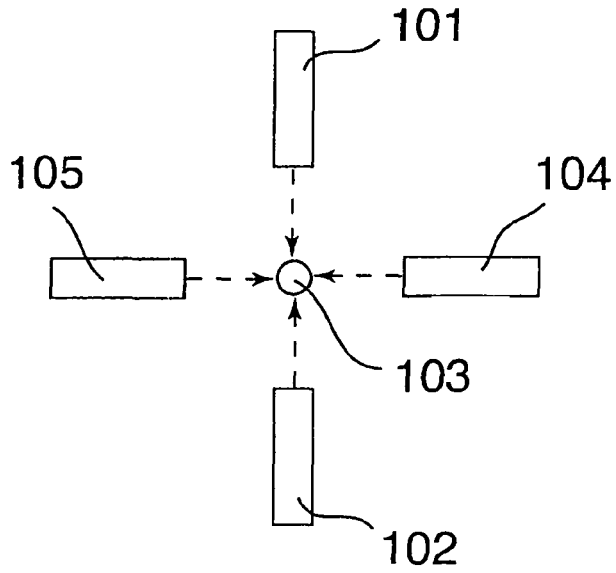
FIG. 57 shows an alternative method for printing the embossed structure.

FIG. 57 shows an arrangement, with which a nonlinear embossed element can be printed with four different printed images. Such an arrangement can likewise be used in the above described embodiments.

Since coating and embossed structure are produced separately from each other, there is always the danger of fluctuations in register, which lead to the fact that the coordination between embossed structure and coating represented as ideal embodiments in the Figures cannot always be met. But since the optically variable effect still occurs in a well visible manner, of course these embodiments are also included by the invention.

The invention claimed is:

1. Security element with an optically variable structure, comprising:

an embossed structure and a coating, wherein the embossed structure and the coating are combined such that at least parts of the coating are completely visible upon perpendicular viewing, but are subject to a shadowing by the embossed structure upon oblique viewing, and wherein the embossed structure has a plurality of identical nonlinear raised embossed elements, on flanks of which a repeating array of identical basic pattern elements of the coating are at least partially disposed such that when changing the viewing direction, different pieces of information become visible in the optically variable structure, wherein the optically variable structure has an additional information, the additional information being formed by varying the shadowing of the coating through a local variation of the arrangement of the nonlinear raised embossed elements relative to the basic pattern elements, wherein each of the basic elements of the coating have a plurality of colored areas, which at least partially are disposed on different flank orientations of the nonlinear raised embossed elements within the local variation of arrangement in respect to the flank orientations of the nonlinear raised embossed element outside of the local variation of arrangement.

2. Security element according to claim 1, wherein at least a part of the nonlinear raised embossed elements is disposed screenlike.

3. Security element according to claim 1, wherein at least a part of the nonlinear raised embossed elements is configured to be tactile.

4. Security element according to claim 1, wherein at least part of the nonlinear raised embossed elements basically has a form selected from the group consisting of a tetrahedron, segment of a sphere, frustum of a pyramid, frustum of a cone, cylinder segment, torus, oval, drop and a pyramid.

5. Security element according to claim 1, wherein the coating is present in the form of a screen.

6. Security element according to claim 1, wherein the coating is selected from the group consisting of a metal layer, a metallic effect layer and an optically variable layer.

7. Security element according to claim 1, wherein the basic pattern elements have at least one colored area.

8. Security element according to claim 1, wherein the basic pattern elements have colored areas in the colors of a primary color system.

9. Security element according to claim 1, wherein the basic pattern elements have at least one of a geometric pattern and alphanumeric information.

10. Security element according to claim 1, wherein the coating at least partially comprises a plurality of basic pattern elements disposed at a distance from each other and the embossed structure at least partially comprises nonlinear raised embossed elements disposed at a distance from each other, wherein at least one basic pattern element at least partially is disposed on the flanks of the nonlinear raised embossed element, so that the at least one basic pattern element and the last-said nonlinear raised embossed element form a structural element.

11. Security element according to claim 1, wherein the optically variable structure has a multitude of structural elements, which upon perpendicular viewing represent a multicolored image motif, the visual effect of which varies when changing the viewing angle.

12. Security element according to claim 11, wherein the structural elements correspond to image points of the image motif, to which certain color components of a color system are allocated, and wherein the basic pattern elements have colored areas in the colors of the color system, wherein the size of the colored areas of the basic pattern elements corresponds to the respective color component of the image points, so that when changing the viewing angle the color effect of the optically variable structure will vary.

13. Security element according to claim 1, wherein the additional information also results from varying the coating.

14. Security element according to claim 13, wherein the additional information results from varying the form or color of the coating.

15. Security element according to claim 13, wherein the additional information results from varying the arrangement of the coating.

16. Security element according to claim 1, wherein the embossed structure has raised areas, and wherein the optically variable structure has an ink layer, which preferably is translucent and which is disposed congruent to the raised areas of the embossed structure.

17. Security element according to claim 1, wherein the optically variable structure has a metallic background layer.

18. Security element according to claim 1, wherein the coating at least in certain areas has machine readable properties.

19. Security element according to claim 1, wherein the coating has magnetic, electrically conductive or luminescent properties.

20. Security element according to claim 1, wherein the optically variable structure is overlaid or underlaid with an additional translucent, optically variable layer or a foil element.

21. Security element according to claim 1, wherein the embossed structure is divided into partial areas, in which different partial embossed structures are disposed.

22. Security element according to claim 21, wherein the partial embossed structures in at least two partial areas adjoining each other are disposed offset by a fraction of the screen ruling.

23. Security element according to claim 21, wherein at least the partial embossed structures of a partial area have an unembossed edge contour.

24. Data carrier comprising a security element according to claim 1, wherein the data carrier is a paper of value and has a printed image area and a printfree area.

25. Use of a security element according to claim 1 for a product protection, wherein the security element is applied to a label or a packaging or directly onto the product.

26. Method for producing a security element with an optically variable structure, which has an embossed structure and a coating, wherein the embossed structure and the coating are combined such that at least parts of the coating are completely visible upon perpendicular viewing, but are subject to a shadowing by the embossed structure upon oblique viewing, comprising:

providing a substrate with an embossed structure, which has a plurality of identical nonlinear raised embossed elements and such that on flanks of the embossed elements a repeating array of identical basic pattern elements of the coating are at least partially disposed such that when changing the viewing direction different pieces of information become visible in the optically variable structure, wherein the embossed structure is created in such a way that the optically variable structure has an additional information, the additional information being formed by varying the shadowing of the coating through a local variation of the arrangement of the nonlinear raised embossed elements relative to the basic pattern elements, wherein each of the basic elements of the coating have a plurality of colored areas, which at least partially are disposed on different flank orientations of the nonlinear raised embossed elements within the local variation of arrangement in respect to the flank orientations of the nonlinear raised embossed element outside of the local variation of arrangement.

27. Method according to claim 26, wherein the coating is printed onto the substrate.

28. Method according to claim 27, wherein the print is produced by a process or apparatus selected from the group consisting of planographic printing, relief printing, screen printing, gravure printing, and a thermographic method.

29. Method according to claim 26, wherein the embossed structure is produced by means of an embossing tool.

30. Method according to claim 26, wherein the embossed structure is produced by intaglio printing.

* * * * *